US012060537B2

(12) United States Patent
Hanthorn et al.

(10) Patent No.: US 12,060,537 B2
(45) Date of Patent: Aug. 13, 2024

(54) CYCLIC PHOSPHONATE ESTERS FOR LUBRICANT APPLICATIONS

(71) Applicant: The Lubrizol Corporation, Wickliffe, OH (US)

(72) Inventors: Jason J. Hanthorn, Eastlake, OH (US); Amanda Freshwater, Avon, OH (US); Christopher M. Rasik, Cleveland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/011,650

(22) PCT Filed: Jun. 24, 2021

(86) PCT No.: PCT/US2021/038913
§ 371 (c)(1),
(2) Date: Dec. 20, 2022

(87) PCT Pub. No.: WO2021/262988
PCT Pub. Date: Dec. 30, 2021

(65) Prior Publication Data

US 2023/0257675 A1 Aug. 17, 2023

Related U.S. Application Data

(60) Provisional application No. 63/043,807, filed on Jun. 25, 2020.

(51) Int. Cl.

| | |
|---|---|
| ***C10M 135/34*** | (2006.01) |
| ***C10M 159/12*** | (2006.01) |
| ***C10M 169/04*** | (2006.01) |
| ***C10N 20/02*** | (2006.01) |
| ***C10N 30/00*** | (2006.01) |
| ***C10N 30/06*** | (2006.01) |
| ***C10N 30/12*** | (2006.01) |
| ***C10N 40/04*** | (2006.01) |

(52) U.S. Cl.
CPC ..... *C10M 159/123* (2013.01); *C10M 135/34* (2013.01); *C10M 169/045* (2013.01); *C10M 2203/1006* (2013.01); *C10M 2219/106* (2013.01); *C10M 2223/02* (2013.01); *C10M 2223/06* (2013.01); *C10N 2020/02* (2013.01); *C10N 2030/06* (2013.01); *C10N 2030/12* (2013.01); *C10N 2030/24* (2020.05); *C10N 2040/04* (2013.01); *C10N 2040/042* (2020.05); *C10N 2040/044* (2020.05); *C10N 2040/045* (2020.05); *C10N 2040/046* (2020.05)

(58) Field of Classification Search
CPC ..... C10M 135/34; C10M 159/123; C10M 169/045; C10M 2203/1006; C10M 2219/106; C10M 2223/02; C10M 2223/06; C10N 2020/02; C10N 2030/06; C10N 2030/12; C10N 2030/24; C10N 2040/04; C10N 2040/042; C10N 2040/044; C10N 2040/045; C10N 2040/046
See application file for complete search history.

(56) References Cited

U.S. PATENT DOCUMENTS

| | | | | |
|---|---|---|---|---|
| 10,611,981 | B2 | 4/2020 | Abraham et al. | |
| 10,793,802 | B2 | 10/2020 | Abraham et al. | |
| 2008/0269088 | A1* | 10/2008 | Baker | C07F 9/657118 568/12 |
| 2017/0335224 | A1* | 11/2017 | Abraham | C10M 153/04 |

FOREIGN PATENT DOCUMENTS

| | | |
|---|---|---|
| WO | 2003/076557 | 9/2003 |

* cited by examiner

*Primary Examiner* — James C Goloboy
(74) *Attorney, Agent, or Firm* — Iken S. Sans; Michael A. Miller

(57) ABSTRACT

Lubricant compositions comprising (a) an oil of lubricating viscosity and (b) a phosphonate ester other than a zinc salt. The phosphonate ester may be the reaction product of (i) phosphonic acid or a monomeric ester thereof with (ii) a propanediol having hydroxy groups in both the 1 and 3 positions and one or more of the carbon atoms of the propyl units are substituted with one or more alkyl groups such that the total number of carbon atoms in the propanediol ranges from 4 to 12. The molar ratio of (i) to (ii) may be 0.9:1.1 to 1.1 to 0.9.

21 Claims, No Drawings

CYCLIC PHOSPHONATE ESTERS FOR LUBRICANT APPLICATIONS

CROSS REFERENCE TO RELATED APPLICATION

This application claims priority from PCT Application Serial No. PCT/US2021/038913 filed on Jun. 24, 2021, which claims the benefit of U.S. Provisional Application No. 63/043,807 filed on Jun. 25, 2020.

BACKGROUND OF THE INVENTION

The disclosed technology relates to cyclic phosphonate esters and their uses in industrial, driveline, and engine oil applications.

Phosphonate esters of various types are well known for their use as lubricant additives. For example, U.S. Publication 2017/0335224, Abraham et al., Nov. 23, 2017, discloses a phosphonate ester mixture comprising the condensation product of phosphonic acid or an ester thereof with a mixture of two diols, wherein the two diols comprise a first alkyl diol that has two hydroxy groups in a 1,4- or 1,5- or 1,6 relationship and a second alkylene diol that is an alkyl-substituted 1,3-propylene diol. The molar ratio of the first and second diol in the mixture ranges from 30:70 to 65:35. The publication further teaches that if the ratio is less than about 30:70, the resulting product may not be effective, and if it is greater than about 65:35, its compatibility with other components in a lubricant formulation may be reduced. While these known phosphorous esters deliver excellent wear performance in driveline applications, it was subsequently found, however, that they can suffer from hydrolytic instability, incompatibility with other components that may be present in a lubricant, or cause demulsification problems in industrial gear oil ("IGO") applications.

SUMMARY OF THE INVENTION

Applicants have developed a new phosphonate ester chemistry that provides a fluid without compatibility issues that will properly demulsify and provide good extreme pressure performance when used in IGO applications. Additionally, these new phosphonate esters show excellent performance in driveline applications. Accordingly, lubricant compositions comprising a phosphonate ester are disclosed herein. The lubricant composition may comprise (a) an oil of lubricating viscosity and (b) a phosphonate ester other than a zinc salt. The phosphonate ester may be the reaction product of (i) phosphonic acid or an ester thereof with (ii) a propanediol having a hydroxy group in the 1 and 3 positions and wherein at least one of the carbon atoms of the propane unit is substituted with an alkyl group such that the total number of carbon atoms in the propanediol ranges from 4 to 12. The molar ratio of (i) to (ii) may be 0.9:1.1 to 1.1 to 0.9.

In some embodiments, the propanediol may comprise an alkyl-substituted 1,3-propanediol with one or more of the alkyl substituents thereof being on one or more of the carbon atoms of the propyl unit such that the total number of carbon atoms in the alkyl-substituted 1,3-propanediol ranges from 5 to 12. In further embodiments, the phosphonate ester may be the reaction product of three components: (i) phosphonic acid or a monomeric ester thereof with an alcohol mixture comprising (ii) a propanediol (as described above) and (iii) an alkanediol having hydroxy groups in a 1,4 or 1,5 or 1,6 relationship. The relative molar amounts of the propanediol (ii) and the alkanediol (iii) in the alcohol mixture may be in a ratio of at least 95:5, for example 95:5, or 95.5:4.5 to 99.5:0.5, or 96:4 to 99:1, or 98:2 to 99:1, or 97:3 to 99:1.

In yet other embodiments, the alcohol mixture further comprises (iv) a mono alcohol having 2 to 20, 2 to 12, 2 to 8, or 2 to 4 carbon atoms. The mono alcohol may be present at 0.1 to 1 wt %, based on a total weight of the total alcohol mixture.

The amount of the disclosed phosphonate ester that may be used in lubricant compositions ranges from 0.05 to 0.5, or 0.05 to 0.75, or 0.05 to 1.0, or 0.1 to 1.0 wt %, based on a total weight of the lubricant composition.

The monomeric phosphonate ester used to make the cyclic phosphonate ester may comprise dimethyl phosphite. The propanediol used to make the cyclic phosphonate ester may comprise 2-ethyl-2-butyl-1,3-propanediol, 2-ethyl-1,3-hexanediol, 2,2-dibutyl-1,3-propanediol, 2-methyl-2-propyl-1,3-propanediol, or combinations thereof. The alkanediol used to make the phosphonate ester may comprise 1,4-butanediol, 1,5-pentanediol, 1,6-hexanediol, or mixtures thereof.

In some embodiments, the phosphonate ester may comprise at least one oligomeric species comprising 2 to 20 or 3 to 20 phosphorus atoms and at least one cyclic monomeric species comprising a single phosphorus atom. In some embodiments, the phosphonate ester may comprise a cyclic monomeric species comprising a single phosphorus atom and a chain of 3 carbon atoms derived from the propanediol. In such embodiments, the amount of the cyclic monomeric species to the amount of the oligomeric species is at least 70% by weight of the cyclic monomeric species. In another embodiment the amount of the cyclic monomeric species to the amount of the oligomeric species is at least 75% by weight.

In some embodiments, the lubricant may have a Timken rating as measured using ASTM D2782 of greater than 45 pounds (lbs). In the same or alternate embodiments, the lubricant composition may have a 4-ball weld point of at least 200 kilograms-force and a load wear index of at least 50 kilograms-force as measured using ASTM D2783. These lubricant compositions comprising the disclosed phosphonate esters may have improved demulsification properties (as measured using ASTM D2711 or D1401) and/or storage stability as compared to primarily oligomeric phosphonate esters.

DETAILED DESCRIPTION OF THE INVENTION

Various preferred features and embodiments will be described below by way of non-limiting illustration.

The lubricant compositions as disclosed herein include, as one component, an oil of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition.

Suitable oils of lubricating technology are not overly limited and include any base oil as specified in the American Petroleum Institute (API) Base Oil Interchangeability Guidelines. The five base oil groups are as follows: Group I (sulfur content>0.03 wt %, and/or <90 wt % saturates, viscosity index 80-120); Group II (sulfur content<0.03 wt %, and >90 wt % saturates, viscosity index 80-120); Group III (sulfur content<0.03 wt %, and >90 wt % saturates, viscosity index>120); Group IV (all poly-alpha-olefins (PAOs) such as PAO-2, PAO-4, PAO-5, PAO-6, PAO-7 or PAO-8); and Group V (all others not included in Groups I, II, III, or IV). The oil of lubricating viscosity may comprise an API Group I, Group II, Group III, Group IV, Group V oil or mixtures thereof.

In some embodiments, the synthetic base oil includes one or more API Group IV base oils. In some embodiments, the synthetic base oil includes one or more polyalphaolefins (PAO). Suitable PAO include PAO-2, PAO-4, PAO-5, PAO6, PAO-7, PAO-8, PAO-40, PAO-100, or any combination thereof. In some embodiments, the synthetic base oil includes PAO-6, PAO-40, PAO-100, or any combination thereof.

Natural oils useful in making the disclosed lubricants and functional fluids include animal oils and vegetable oils as well as mineral lubricating oils such as liquid petroleum oils and solvent-treated or acid-treated mineral lubricating oils of the paraffinic, naphthenic or mixed paraffinic/-naphthenic types which may be further refined by hydrocracking and hydrofinishing processes.

Synthetic lubricating oils include hydrocarbon oils and halo-substituted hydrocarbon oils such as polymerized and interpolymerized olefins (e.g. polybutylenes, polypropylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated biphenyl ethers and alkylated biphenyl sulfides and the derivatives, analogs and homologs thereof or mixtures thereof. Also included are alkylene oxide polymers and interpolymers and derivatives thereof, in which the terminal hydroxyl groups may have been modified by esterification or etherification. Also included are esters of dicarboxylic acids with a variety of alcohols, or esters made from $C_5$ to $C_{12}$ monocarboxylic acids and polyols or polyol ethers. Other synthetic oils include silicon-based oils, liquid esters of phosphorus-containing acids, and polymeric tetrahydrofurans. In some embodiments the oil of lubricating viscosity used in the invention is a synthetic oil that includes polymerized polyisobutylene, and in some embodiments the oil of lubricating viscosity used in the invention is a synthetic oil that includes polymerized polyisobutylene and a polyalphaolefin.

Unrefined, refined, and re-refined oils, either natural or synthetic, can be used in the lubricants disclosed herein. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation. The oil can also be an oil derived from hydroisomerization of wax such as slack wax or a Fischer-Tropsch synthesized wax.

Other oils are materials commonly known as traction fluids. These include polymers of at least one olefin containing 3 to 5 carbon atoms; hydrocarbon molecules containing non-aromatic cyclic moieties; as fluids comprising naphthenic hydrocarbons having 19 carbon atoms, e.g., comprising two substituted cyclohexane rings linked by a methylene group; hydrogenated dimers of α-alkyl styrene; hydrogenated polyolefins and adamantane ethers.

In certain embodiments, a compatibilizer may be used. Suitable compatibilizers include linear and branched saturated alcohols, however in some embodiments the compatibilizer includes one or more branched saturated alcohols. In some embodiments, the compatibilizer is essentially free or, or even completely free of, linear saturated alcohols.

In some embodiments, the compatibilizer includes a branched, primary, saturated alcohol. In some embodiments, the compatibilizer is essentially free or, or even completely free of, unsaturated alcohols. In some embodiments, the compatibilizer is essentially free or, or even completely free of, secondary alcohols.

In some embodiments, the compatibilizer includes one or more a Guerbet alcohols. Guerbet alcohols may be described as alcohols made via the Guerbet reaction, which was named after Marcel Guerbet. In a Guerbet reaction, a primary aliphatic alcohol is converted to its β-alkylated dimer alcohol (i.e., a branched, primary, saturated alcohol).

In certain embodiments, for example driveline fluids, the oil of lubricating viscosity may comprise a poly-alpha-olefin (PAO). Typically, poly-alpha-olefins are hydrogenated materials derived from monomers having 4 to 30, or 4 to 20, or 6 to 16 carbon atoms. Examples of useful PAOs include those derived from 1-decene. These PAOs may have a viscosity of 1.5 mm2/s to 160 $mm^2/s$ (cSt) at 100° C., or 1.5 $mm^2/s$ (cSt) to 8.5 $mm^2/s$ (cSt) at 100° C., or 2.5 to 6.5 $mm^2/s$ (cSt), or even 3.5 to 6.5 $mm^2/s$ (cSt) at 100° C. In some embodiments, the oil of lubricating viscosity may be a blend of PAO that are selected to provide the desired properties, particularly viscosity to the finished lubricant. The oil of lubricating viscosity may also be mixed with a viscosity modifier to such that the finished lubricant has a desired viscosity or viscosity profile.

In some embodiments, for example in industrial gear oils, the oil of lubricating viscosity may be a Group I base oil having a kinematic viscosity at 40° C., of 8 to 500 cSt ($mm^2/s$) or 18 to 500 cSt ($mm^2/s$), or 18 to 115 cSt ($mm^2/s$). As used herein, the kinematic viscosity at 40° C. is measured by the methodology of ASTM D445. As with the PAO base oils, in some embodiments the oil of lubricating viscosity may be a blend of more than one Group I base oil and/or a viscosity modifier to provide the desired properties, particularly viscosity to the finished lubricant. In one embodiment, the oil of lubricating viscosity is a blend of at least two Group I base oils that are selected and blended such that the viscosity of the finished lubricant has a viscosity of 18 to 115, or even 100 cSt (SUS) at 40° C.

In certain embodiments, for example industrial gear oils, the lubricant composition may have a kinematic viscosity at 40° C. as specified in ISO 3448 ranging between 41.4 to 1100 cSt ($mm^2/s$) or 61.2 to 748 cSt ($mm^2/s$) or 61.2 to 506 cSt ($mm^2/s$).

In certain embodiments, for example automatic or manual transmission fluids, the lubricant compositions may have a kinematic viscosity at 100° C. of 2.8 cSt ($mm^2/s$) to 8.0 cSt ($mm^2/s$) or 3.0 cSt ($mm^2/s$) to 7.0 ($mm^2/s$) or 3 to 6.5 cSt ($mm^2/s$).

Phosphorus-Containing Compound

The formulations described herein contain a novel phosphonate ester composition. The phosphonate ester composition may comprise a single phosphonate ester species or may comprise two or more phosphonate ester species. The phosphonate ester composition may be other than a zinc salt, that is it may be a composition that is substantially free of zinc. As used herein, "substantially free" means that the amount of the material in question is less than an amount that will affect the relevant performance of the lubricant in a measurable way.

The phosphonate ester will comprise the reaction product, e.g., condensation product, of phosphonic acid ($H_3PO_3$), or a monomeric ester thereof (i) with at least one propanediol (ii). By "monomeric" phosphonate ester is meant a phosphonate ester, typically containing one phosphorus atom and having two separate alkyl groups of from one to six carbon atoms each, which may be reacted with the polyol in order to form an oligomeric, polymeric, or other condensed species. The alkyl groups of the monomeric phosphonate ester may be relatively low molecular weight groups of 1 to 6 or 1 to 4 carbon atoms, such as methyl, ethyl, propyl, or butyl, such that the alcohol generated upon reaction with the alkylene diols may be easily removed. An exemplary monomeric phosphonate ester is dimethyl phosphite; others include diethyl phosphite, dipropyl phosphite, and dibutyl phosphite. Accordingly, in some embodiments, the monomeric phosphonate ester used to make the cyclic phosphonate ester may comprise dimethyl phosphite.

Sulfur-containing analogues may also be employed (e.g., thiophosphites). Other esters include trialkyl phosphites. Mixtures of di- and trialkyl phosphites may also be useful. In these materials, the alkyl groups may be the same or different each independently typically having 1 to 6 or 1 to 4 carbon atoms as described above.

The monomeric phosphonate ester (i) will be reacted or condensed with at least one propanediol (ii) to form the material of the disclosed technology, which includes a monomeric cyclic phosphonate species. The propanediol may have at least one hydroxy group in both the 1 and 3 positions and one or more of the carbon atoms of the propyl units are substituted with one or two alkyl groups such that the total number of carbon atoms in the propanediol ranges from 4 to 12. The molar ratio of the phosphonic acid or ester (i) to the propanediol (ii) may be 0.9:1.1 to 1.1 to 0.9. In some embodiments, the propanediol may comprise an alkyl-substituted 1,3-propanediol with one or more of the alkyl substituents thereof being on one or more of the carbon atoms of the propyl unit such that the total number of carbon atoms in the diol ranges from 5 to 12 or 6 to 12 or 7 to 12 or 8 to 12 or, in certain embodiments, 9 to 12, or even 9. That is, the alkyl-substituted propanediol may be represented by the general formula

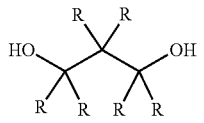

where the various R groups may be the same or different and may be hydrogen or an alkyl group, provided that at least one R is an alkyl group and that the total number of carbon atoms in the R groups is 2 to 9 or 3 to 9, so that the total carbon atoms in the diol will be 5 to 12 or 6 to 12, respectively, and likewise for the other ranges of total carbons. Reference here to propanediols means that the two hydroxy groups are in a 1,3 relationship to each other, that is, separated by a chain of 3 carbon atoms. Thus, the propanediol may thus also be named as a 2,4- or 3,5- or 4,6-diol depending on the position of the two hydroxy groups on the longest alkyl chain of the molecule. If the 1,3-propaendiol has one or more secondary hydroxy groups, such a molecule will be considered to be an internal diol. In one embodiment the number of alkyl substituents is two and the total number of carbon atoms in the molecule is 9. Suitable substituents may include, for instance, methyl, ethyl, propyl, and butyl (in their various possible isomers).

Examples of the 1,3-propanediol may include 2,2-dimethyl-1,3-propanediol, 2-ethyl-2-butyl-1,3-propanediol, 2-ethyl-1,3-hexanediol, 2,2-dibutyl-1,3-propanediol, 2,2-diisobutyl-1,3-propanediol, 2-methyl-2-propyl-1,3-propanediol, 2-propyl-1,3-propanediol, 2-butyl-1,3-propanediol, 2-pentyl-1,3-propanediol, 2-methyl-2-propyl-1,3-propanediol, 2,2-diethyl-1,3-propanediol, 2,2,4-trimethyl-1,3-pentanediol, 2-methyl-2,4-pentanediol, 2,4-dimethyl-2,4-pentanediol, and 2,4-hexanediol. It should be noted that some of the foregoing nomenclature emphasizes the -1,3-propanediol structure of the molecules, for clarity. For instance, 2-pentyl-1,3-propanediol might also be named 2-hydroxymethyl-1-heptanol, but the latter nomenclature does not so clearly illustrate the 1,3-nature of the diol. In yet other embodiments, the 1,3-propandiol may comprise 2-butyl-2-ethyl-1,3-propanediol (BEPD).

In further embodiments, the phosphonate ester comprises the reaction product of three components: (i) phosphonic acid or an ester thereof with an alcohol mixture comprising (ii) a propanediol and (iii) an alkane diol having hydroxy groups in a 1,4 or 1,5 or 1,6 relationship. The propanediol (ii) will always be present in a greater amount than the alkane diol (iii) in the alcohol mixture. The alcohol mixture should contain at least 95 moles of the propanediol (ii) for every 5 moles of alkane diol. Accordingly, in some embodiments, the molar ratio of the propanediol (ii) to the alkane diol (iii) in the alcohol mixture is any ratio greater than 95:5. In yet other embodiments, the relative molar amounts of the propanediol (ii) to the alkane diol (iii) in the alcohol mixture may be in a ratio of 95.5:4.5 to 99.5:0.5, or 96:4 to 99:1, or 98:2 to 99:1, or 97:3 to 99:1.

As noted above, the alkane diol (iii) is a 1,4- or 1,5- or 1,6-alkane diol with hydroxy groups in a 1,4 or 1,5 or 1,6 relationship to each other, separated by a chain of 4, 5, or 6 carbon atoms, respectively. The first hydroxy group may be on the carbon 1 atom, that is, on the a carbon of the diol, or it may be on a higher numbered carbon atom. For example, the diol may also be a 2,5- or 2,6-, or 2,7-diol or a 3,6- or 3,7- or 3,8-diol, as will be evident to the skilled person. The alkane diol may be branched (e.g., alkyl-substituted) or unbranched and in one embodiment is unbranched. Unbranched, that is, linear diols ($\alpha,\omega$-diols) include 1,4-butanediol, 1,5-pentane diol, and 1,6-hexanediol. Branched or substituted diols include 1,4-pentanediol, 2-methyl-1,5-pentanediol, 3-methyl-1,5-pentanediol, 3,3-dimethyl-1,5-pentanediol, 1,5-hexanediol, 2,5-hexanediol, and 2,5-dimethyl-2,5-hexanediol. For purposes of the disclosed technology, a diol having one or more secondary hydroxy groups (such as 2,5-hexanediol) may be referred to as an internal diol. In certain embodiments the alkane diol (iii) may be 1,6-hexanediol. In yet other embodiments, the propanediol (ii) may comprise 2-butyl-2-ethyl-1,3-propanediol (BEPD) and the alkane diol (iii) may comprise 1,6-hexanediol. The ratio of the BEPD to the 1,6-hexanediol may range from 95.5:4.5 to 99.5:0.5, or 96:4 to 99:1, or 98:2 to 99:1, or 97:3 to 99:1

The alkane diol (iii) may, if desired, have additional hydroxy groups, that is, more than two per molecule, or there may be exactly two. In one embodiment, there are exactly two hydroxy groups per molecule. Also, care should be taken to avoid excessive branching or crosslinking in the product, which could lead to undesirable gel formation. Such problems may be avoided by careful control of reaction conditions such as control of the ratio of reagents and the order of their addition, performing the reaction under suitably dilute conditions, and reacting under low acid conditions. These conditions can be determined by the person skilled in the art with only routine experimentation.

In yet other embodiments, the alcohol mixture further comprises (iv) a mono alcohol having 2 to 20, 2 to 12, 2 to 8, or 2 to 4 carbon atoms. The mono alcohol may be present at 0.1 to 1 mol %, based on a total weight of the total alcohol mixture.

The relative molar amounts of the phosphonic acid or monomeric ester thereof (a) and the total molar amounts of the diols (b) may be in a ratio of 0.9:1.1 to 1.1:0.9, or 0.95:1.05 to 1.05:0.95, or 0.98:1.02 to 1.02:0.98, or about 1:1.

In some embodiments, the phosphonate ester may comprise at least one oligomeric species comprising 2 to 20 or 3 to 20 phosphorus atoms and at least one cyclic monomeric species comprising a single phosphorus atom. In some embodiments, the phosphonate ester may comprise a cyclic monomeric species comprising a single phosphorus atom and a chain of 3 carbon atoms derived from the propanediol. In such embodiments, the relative amount of the cyclic monomeric species to the amount of the oligomeric species may be 8:1 to 3:1 or 7.5:1 to 3.5:1 by weight.

The cyclic phosphonate ester species may comprise one phosphorus atom, one hydrogen, and one oxygen from the monomeric phosphonic ester reactant, and a carbon and oxygen containing moiety derived from the 1,3-propanediol (ii), as the 1,3-propylene diol is capable of either participation in oligomerization or cyclic ester formation. The oligomeric or polymeric species may typically comprise 2 or 3 to 20 phosphorus atoms, or alternatively 5 to 10 phosphorus atoms, linked together by alkyl groups derived from the 1,3-propanediol and/or the alkane diol having two hydroxy groups in a 1,4-, 1,5-, or 1,6-relationship, which are less readily able to cyclize with the phosphorus to form a cyclic monomeric species.

The product of the disclosed technology may be a mixture of species that may be represented by the structures shown:

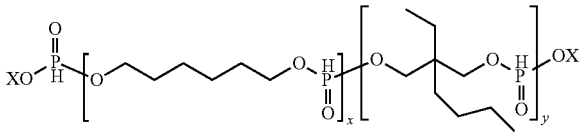

(oligomeric or polymeric species)

plus

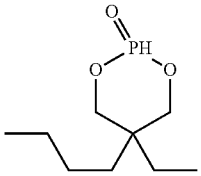

(cyclic monomer species)

where x and y represent the relative amounts of the two diols incorporated into the oligomer. The structure shown is not intended to indicate that the polymer is necessarily a block polymer, since the structures represented by the x and y brackets may be more or less randomly distributed, as influenced by or depending on the availability of the various diol reactants. Each X is independently a terminating group, which may be, for instance, an alkyl group (such as methyl), or hydrogen or a diol-derived moiety which might terminate in an OH group. In the above scheme, for illustrative purposes only, the alkylene diol is selected to be 1,6-hexanediol and the 1,3-propanediol is selected to be 2-butyl-2-ethyl-1,3-propanediol. Corresponding structures and mixtures would be formed using different alkane diols and 1,3-propanediols.

The relative amounts of oligomeric species and cyclic monomer species in the reaction mixture will depend, to some extent, on the specific diols selected and the reaction conditions. In certain embodiments, 75 to 90% by weight of the phosphonate ester will be cyclic form and 25 to 10% of the product will be in oligomeric form.

When using only 1,3-propanediol and no alkane diols having two hydroxy groups in a 1,4 or 1,5 or 1,6 relationship, the phosphonate esters formed will be about 80% cyclic to about 20% oligomeric (80:20 cyclic:oligomeric) by weight of the total weight of the esters formed.

For reaction products prepared from 1,6-hexane diol and 2-butyl-2-ethyl-1,3-propanediol, as in the structures above, generally less than 40 mol % of 1,6 hexane diol and at least 40 mol % of the 1,3-propanediol is used as using these alcohols in a ratio of 40:60 mol % results in a phosphonate ester that is 50:50 cyclic:oligomer by weight. The amount of cyclic product obtained by reaction at 135° C. may be approximately as shown in the table below:

| | | |
|---|---|---|
| mol % 1,6-hexane diol | 4.5 | 1 |
| mol % 2-butyl-2-ethyl-1,3-propanediol | 95.5 | 99 |
| wt % cyclic | 78 | 88 |

The amount of the oligomeric species may be 100% minus the percentage of the cyclic phosphonate ester. It is also possible that, regardless of the specific diols employed, mixtures having the above weight percentages of oligomer and cyclic monomer may be usefully prepared. Accordingly, in some embodiments the relative amount of the cyclic monomeric species to the amount of the oligomeric species is 8:1 to 3:1 or 7.5:1 to 3.5:1 by weight.

The condensation reaction between the phosphonic acid or ester and the diol mixture may be accomplished by mixing the reagents and heating until the reaction is substantially complete. Alternatively, the phosphonic acid or ester may be added slowly to a pre-heated mixture of the diols. Typically, if a mixture of diols is used, both diols will be mixed with the phosphonic acid or ester compound at the same time or nearly the same time, that is, typically before the reaction with one of the diols is complete. A small amount of a basic material such as sodium methoxide may also be present. If a methyl ester of phosphonic acid is used as a reagent, substantial completion of the reaction may correspond with the cessation of evolution and distillation of methanol from the reaction mixture. Reduced pressure may be advantageously employed in the later stages of the reaction to aid in the removal of residual methanol. Suitable temperatures include those in the range of 100 to 140° C., such as 110 to 130° C. or 115 to 120° C. If reaction temperatures in excess of about 140° C. are employed, there is a risk that the desired product may not be formed in useful yields or with useful purity, since competing reactions may occur. Reaction times may typically be up to 12 hours, depending on temperature, applied pressure (if any), agitation, and other variables. In some instances, reaction times of 2 to 8 hours or 4 to 6 hours may be appropriate.

The amount of the phosphonate ester product described above used in lubricants may be an amount sufficient to provide 0.01 to 0.3 or to 0.1 weight percent phosphorus to the lubricating oil composition or, in other embodiments, 0.02 to 0.07 weight percent or 0.025 to 0.05 weight percent. The actual amount of the phosphonate ester product which corresponds to these amounts of phosphorus will, of course, depend upon its phosphorus content. Suitable amounts of the phosphonate ester product in the lubricant composition may be 0.05 or 0.06 to 2.0 weight percent, or 0.1 to 1, or 0.05 to 0.5, or 0.1 to 0.3, or 0.15 to 0.23, or 0.15 to 0.5, or 0.2 to 0.3 weight percent. In some embodiments, the amount of the disclosed phosphonate ester that may be used in lubricant compositions ranges from 0.05 to 0.5, or 0.05 to 0.75, or 0.05, or 0.1 to 1.0 wt %, based on a total weight of the lubricant composition. When used in an industrial gear oil, the phosphonate ester may be present at 0.1 to 0.5 wt %, based on a total weight of the industrial gear oil. When used in a driveline lubricant, the phosphonate ester may be present at 0.1 to 0.5, or 0.1 to 0.75, or 0.1 to 1.0 wt %, based on a total weight of the driveline lubricant. In some embodiments, the amount of the phosphonate ester is present in the lubricant composition in an amount to provide 0.005 to 0.3 weight percent phosphorus to the lubricant composition, based on a total weight of the lubricant composition.

These phosphonate esters provide a fluid without combability issues that will demulsify and provide good extreme pressure performance when used in industrial gear oil applications. Additionally, they show excellent performance in driveline applications. It was also surprisingly found that phosphonate esters disclosed herein have an improved Daphnia EC50 performance at 48 hours as measured using OEDC 202 as compared to the phosphonate esters disclosed in U.S. Publication 2017/0335224, Abraham et al.

Other Materials

The lubricants described herein may comprise other materials to provide the lubricants with desired properties for a given lubricant type or application. Suitable additional materials are not overly limited, some of which are described below.

Phosphorus-Containing Antiwear and/or Extreme Pressure Agents

In some embodiments, the lubricant compositions may comprise known phosphorus-containing antiwear and/or extreme pressure agents in addition to the novel phosphonate esters disclosed herein. These known phosphorus-containing antiwear and/or extreme pressure agents that are typically used in industrial gear lubricants are for the most part partially or fully esterified phosphates. All of these are suitable for the lubricant compositions disclosed herein, including industrial gear lubricant compositions. Such antiwear agents include, but are not limited to, acid phosphates, hydrogen phosphites, phosphites, phosphates, phosphonates, phosphinates, and phosphoroamidates. Further antiwear agents can also include mono, di and trihydrocarbyl phosphites; mono, di, and trihydrocarbyl phosphates; mono, di, and trihydrocarbyl mono, di, tri, tetrathiophosphates; mono, di, trihydrocarbyl mono, di, tri, tetrathiophosphites; various hydrocarbyl phosphonates and thiophosphonates; various hydrocarbyl phosphonites and thiophosphonites, and the like.

Examples of phosphites include mono-hydrocarbyl substituted phosphite, a di-hydrocarbyl substituted phosphite, or a tri-hydrocarbyl substituted phosphite, and those phosphites having at least one hydrocarbyl group with 4 or more carbon atoms as represented by the formulae:

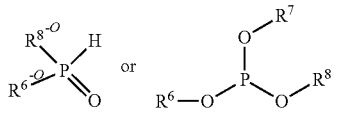

wherein at least one of $R^8$, $R^6$ and $R^7$ may be a hydrocarbyl group containing at least 4 carbon atoms and the other may be hydrogen or a hydrocarbyl group. In one embodiment $R^8$, $R^6$ and $R^7$ are all hydrocarbyl groups. The hydrocarbyl groups may be alkyl, cycloalkyl, aryl, acyclic or mixtures thereof. In the formula with all three groups $R^8$, $R^6$ and $R^7$, the compound may be a tri-hydrocarbyl substituted phosphite i.e., $R^8$, $R^6$ and $R^7$ are all hydrocarbyl groups. Alkyl groups may be linear or branched, typically linear, and saturated or unsaturated, typically saturated. Examples of alkyl groups for $R^8$, $R^6$ and $R^7$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof.

Amine salts that can be formed with the above-mentioned phosphorus containing antiwear agents are included. The amines can be primary, secondary, tertiary, acyclic or cyclic, mono or polyamines. They can also be heterocyclic. The preferred amines are generally aliphatic in nature. Some specific examples of amines for producing amine salts of the phosphorus-containing antiwear agents include: octylamine, decylamine, C10, C12, C14 and C16 tertiary alkyl primary amines (or combinations thereof), laurylamine, hexadecylamine, heptadecylamine, octadecylamine, decenylamine, dodecenylamine, palmitoylamine, oleylamine, linoleylamine, di-isoamylamine, di-octylamine, di-(2-ethylhexyl) amine, dilaurylamine, cyclohexylamine, 1,2-propylene amine, 1,3-propylenediamine, diethylene triamine, triethylene tetraamine, ethanolamine, triethanolamine, trioctylamine, pyridine, morpholine, 2-methylpiperazine, 1,2-bis(N-piperazinyl-ethane), 1,2-diamine, tetraminooctadecene, triaminooctadecene, N-hexylaniline and the like. The amines may also be triazole or triazole derivatives.

In an embodiment, an amine salt of the phosphorus-containing antiwear agent are those of the formula:

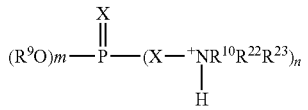

where $R^9$ and $R^{10}$ are independently aliphatic groups containing from about 4 up to about 24 carbon atoms, $R^{22}$ and $R^{23}$ are independently hydrogen or aliphatic groups containing from about 1 up to about 18 aliphatic carbon atoms, the sum of m and n is 3 and X is oxygen or sulfur. In a preferred embodiment, $R^9$ contains from about 8 up to 18 carbon atoms, $R^{10}$ is:

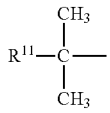

wherein $R^{11}$ is an aliphatic group containing from about 6 up to about 12 carbon atoms, $R^{22}$ and $R^{23}$ are hydrogen, m is 2, n is 1 and X is oxygen.

Specific examples of phosphorus-containing antiwear agents can include tricresyl phosphate, tributylphosphite, triphenyl phosphite, 2-ethylhexyl phosphate, diisobutylhydrogen phosphite, diisopropyl dithiophosphate, diphenyl phosphate, fatty phosphites, etc. Some embodiments of phosphorus-containing antiwear agents can include the dialkyl and diaryl phosphates and their amine salts. Also considered are aryl phosphates, such as the commercially available Irgalube™ 349 from Ciba and alkyl acid phosphates, including di- and/or mono-2-ethylhexyl phosphoric acid.

In an embodiment, the phosphorus-containing antiwear agent is a substantially sulfur-free alkyl phosphate amine salt having at least 30 mol percent of the phosphorus atoms in an alkyl pyrophosphate (sometimes referred to as the POP structure), as opposed to an orthophosphate (or monomeric phosphate) structure as described in (WO2017/079016).

In some embodiments, the additional phosphorous compound may be a phosphorus ester containing zinc. An example of a zinc-containing composition is a zinc dialkyldithiophosphate.

Dispersant

The compositions of the invention may also include nitrogen-containing dispersants, for example, a hydrocarbyl substituted nitrogen containing additive. Suitable hydrocarbyl substituted nitrogen containing additives include ashless dispersants and polymeric dispersants. Ashless dispersants are so-named because, as supplied, they do not contain metal and thus do not normally contribute to sulfated ash when added to a lubricant. However, they may, of course, interact with ambient metals once they are added to a lubricant which includes metal-containing species. Ashless dispersants are characterized by a polar group attached to a relatively high molecular weight hydrocarbon chain. Examples of such materials include succinimide dispersants, Mannich dispersants, and borated derivatives thereof.

Succinimide dispersants, a species of carboxylic dispersants, are prepared by the reaction of a hydrocarbyl-substituted succinic anhydride or reactive equivalent thereof with an amine such as a poly(ethyleneamine). The hydrocarbyl substituent group generally contains an average of at least 8, or 20, or 30, or 35 up to 350, or to 200, or to 100 carbon atoms. In one embodiment, the hydrocarbyl group is derived from a polyalkene such as polyisobutene which may have an $M_n$ (number average molecular weight) of at least 500, e.g., 500, or 700, or 800, or 900 up to 5000, or to 2500, or to 2000, or to 1500. In one embodiment the polydispersity ($M_w/M_n$) is at least 1.5. The substituted succinic acylating agent can be reacted with an amine, including those amines described above and heavy amine products known as amine still bottoms. The amount of amine reacted with the acylating agent is typically an amount to provide a mole ratio of CO:N of 1:2 to 1:0.75. If the reaction is with an alcohol, the resulting dispersant will be an ester dispersant. If both amine and alcohol functionality are present, whether in separate molecules or in the same molecule (as in the above-described condensed amines), mixtures of amide, ester, and possibly imide functionality can be present. These are the so-called ester-amide dispersants.

"Amine dispersants" are reaction products of relatively high molecular weight aliphatic or alicyclic halides and amines, such as polyalkylene polyamines. "Mannich dispersants" are the reaction products of alkyl phenols in which the alkyl group contains at least 30 carbon atoms with aldehydes (especially formaldehyde) and amines (especially polyalkylene polyamines). "Ester dispersants" are similar to the above-described succinimide dispersants except that they may be seen as having been prepared by reaction of a hydrocarbyl acylating agent and a polyhydric aliphatic alcohol such as glycerol, pentaerythritol, or sorbitol, as described in U.S. Pat. No. 3,381,022. Aromatic succinate esters may also be prepared; see US 2010/0286414.

Post-treated dispersants may also be used. They are generally obtained by reacting a carboxylic (e.g., succinimide), amine or Mannich dispersant with reagents such as urea, thiourea, carbon disulfide, aldehydes, ketones, carboxylic acids, hydrocarbon-substituted succinic anhydrides, nitriles, epoxides, boron compounds such as boric acid (to give "borated dispersants"), phosphorus compounds such as phosphorus acids or anhydrides, 2,5-dimercaptothiadiazole (DMTD), or an aromatic diacid having acid groups in 1,3 or 1,4 positions on a benzene ring (such as terephthalic acid). Mixtures of dispersants can also be used. In one embodiment a dispersant is present, which is a borated dispersant that is further functionalized with a sulfur or phosphorus moiety. In one embodiment the borated dispersant may be a borated polyisobutylene succinimide dispersant, in which the polyisobutylene portion thereof may have a number average molecular weight of 750 to 2200, or 750 to 1350, or 750 to 1150.

In one embodiment, both a borated dispersant and a non-borated dispersant may be present. The non-borated dispersant may be a hydrocarbyl-substituted succinimide, such as a polyisobutylene succinimide wherein the polyisobutylene portion thereof has a number average molecular weight of about 750 to about 2200, or about 750 to about 1350, or about 750 to about 1150.

The borated and non-borated dispersants may be obtained or obtainable from reaction of succinic anhydride by an "ene" or "thermal" reaction, by what is referred to as a "direct alkylation process." The "ene" reaction mechanism and general reaction conditions are summarized in "Maleic Anhydride," pages, 147-149, B. C. Trivedi and B. C. Culbertson, Plenum Press, 1982. The non-borated dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The borated and non-borated dispersants may also be obtained or obtainable from a chlorine-assisted process, often involving Diels-Alder chemistry, leading to formation of carbocyclic linkages. The process is known to a person skilled in the art. The chlorine-assisted process may produce a non-borated dispersant that is a polyisobutylene succinimide having a carbocyclic ring present on 50 mole % or more, or 60 to 100 mole % (typically 100 mole %) of the dispersant molecules. Both the thermal and chlorine-assisted processes are described in greater detail in U.S. Pat. No. 7,615,521, columns 4-5 and preparative examples A and B.

Dispersants may be prepared from a polyolefin as the hydrocarbyl group, and the polyolefin may be, in certain embodiments, high vinylidene polyisobutylene, that is, having greater than 50, 70, or 75% terminal vinylidene groups (α and β isomers). In certain embodiments, the succinimide dispersant may be prepared by the direct alkylation route. In other embodiments it may comprise a mixture of direct alkylation and chlorine-route dispersants. In certain embodiments the dispersant component may be a mixture of multiple dispersants which may be of different types; optionally at least one may be a succinimide dispersant.

The non-borated dispersant may have a nitrogen to carbonyl ratio (N:CO ratio) of 1:5 to 10:1, 1:2 to 10:1, or 1:1 to 10:1, or 1:1 to 5:1, or 1:1 to 2:1. In one embodiment the non-borated dispersant may have a N:CO ratio of 1:1 to 10:1, or 1:1 to 5:1, or 1:1 to 2:1. The borated dispersant(s) of the present invention may be prepared in such a way to have a N:CO ratio of 0.9:1 to 1.6:1, or 0.95:1 to 1.5:1, or 1:1 to 1.4:1.

The amount of dispersant or dispersants in the compositions, may be, for instance, 0.3 to 10 percent by weight. In other embodiments, the amount is 0.5 to 7 percent or 1 to 5 percent of the final blended fluid formulation. In a concentrate, the amounts will be proportionately higher.

Detergent

The compositions may also include a detergent, that is, a metal salt of an organic acid containing an oleophilic moiety. The organic acid portion of the detergent is typically a sulfonate, carboxylate, phenate, or salicylate. The metal portion of the detergent is typically an alkali or alkaline earth metal. Suitable metals include sodium, calcium, potassium, and magnesium. The detergent may be a neutral detergent or overbased. In neutral detergents, the organic acid portion is stoichiometrically equivalent to the metal base portion. Alternatively, the detergents may be overbased, meaning that there is a stoichiometric excess of metal over that needed to form the neutral metal salt. Suitable overbased organic salts include organic sulfonate salts having a substantially oleophilic character. Organic sulfonates are well known materials in the lubricant and detergent arts. The sulfonate compound may contain on average 10 to 40 carbon atoms, or 12 to 36 or 14 to 32 carbon atoms on average. Similarly, the phenates, salicylates, and carboxylates have a substantially oleophilic character. Typically, the excess metal will be present over that which is required to neutralize the acid in the ratio of up to 30:1, preferably 5:1 to 18:1 on an equivalent basis.

The amount of the detergent utilized in the composition may be typically 0.01 to 10 weight percent or 0.025 to 3 weight percent on an oil free basis, e.g., 0.1 to 6, or 0.2 to 5, or 0.5 to 4, or 1 to 3, or 0.1 to 1.0 percent. If the detergent is overbased, it is usually made up in about 50% oil with a TBN range of 10-1000, or 10-600 or 200 or greater, or 200 to 600, or 250-1000, on an oil free basis. Borated and non-borated overbased detergents are described in U.S. Pat. Nos. 5,403,501 and 4,792,410. A more detailed description of the expressions "metal ratio," TBN and "soap content" are known to a person skilled in the art and explained in standard textbook entitled "Chemistry and Technology of Lubricants", Third Edition, Edited by R. M. Mortier and S. T. Orszulik, 2010, pages 219 to 220, under the sub-heading 7.2.5, Detergent Classification. TBN may be measured according to ASTM D4739.

In certain embodiments the detergent may comprise a calcium-containing detergent. In certain embodiments, the calcium-containing detergent may be a calcium sulfonate or a calcium phenate detergent, and in some embodiments, a calcium sulfonate detergent.

In one embodiment the sulfonate detergent may be a predominantly linear alkylbenzene sulfonate detergent having a metal ratio of at least 8 as is described in paragraphs [0026] to [0037] of U.S. Pat. No. 7,407,919. Linear alkyl benzenes may have the benzene ring attached anywhere on the linear chain, usually at the 2, 3, or 4 position, or mixtures thereof. The predominantly linear alkylbenzene sulfonate detergent may provide benefits in fuel economy. In one embodiment the sulfonate detergent may be a metal salt of one or more oil-soluble alkyl toluene sulfonate compounds as disclosed in paragraphs [0046] to [0053] of US 2008/0119378.

In one embodiment, a sulfonate detergent may be a branched alkylbenzene sulfonate detergent. Branched alkylbenzene sulfonate may be prepared from isomerized alpha olefins, oligomers of low molecular weight olefins, or combinations thereof. Suitable oligomers include tetramers, pentamers, and hexamers of propylene and/or butylene. In other embodiments, an alkylbenzene sulfonate detergent may be derived from a toluene alkylate, i.e., the alkylbenzene sulfonate may have at least two alkyl groups, at least one of which is a methyl group, the other being a linear or branched alkyl group as described above.

Phenate detergents are typically derived from p-hydrocarbyl phenols or, generally, alkylphenols. Alkylphenols of this type may be coupled with sulfur and overbased, coupled with aldehyde and overbased, or carboxylated to form salicylate detergents. Suitable alkylphenols or alkylsalicylates include those alkylated with oligomers of propylene, i.e. tetrapropenylphenol (i.e. p-dodecylphenol or PDDP) and pentapropenylphenol. Suitable alkylphenols or alkylsalicylates also include those alkylated with oligomers of butene, especially tetramers and pentamers of n-butenes. Other suitable alkylphenols or alkylsalicylate include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent or salicylate detergent derived from PDDP. In one embodiment, the lubricant composition comprises a phenate detergent or salicylate detergent that is not derived from PDDP. In one embodiment, the lubricating composition comprises a phenate detergent or salicylate detergent prepared from PDDP, such detergent contains less than 1.0 weight percent unreacted PDDP, or less than 0.5 weight percent unreacted PDDP, or is substantially free of PDDP.

The metal-containing detergent may be present in an amount to deliver 130 ppm to 600 ppm, or 160 ppm to 400 ppm, or in other embodiments 300 to 10,000 ppm, of metal, and in some embodiments, such amounts of calcium, to the lubricant formulation. The overall amount of the detergent may be as described above. The term "ppm" means parts per million by weight.

Antifoams

The compositions of the invention may also include antifoams, also known as foam inhibitors, are known in the art and include but are not limited to organic silicones and non-silicon foam inhibitors. Examples of organic silicones include dimethyl silicone and polysiloxanes. Examples of non-silicon foam inhibitors include but are not limited to polyethers, polyacrylates and mixtures thereof as well as copolymers of ethyl acrylate, 2-ethylhexylacrylate, and optionally vinyl acetate. In some embodiments the antifoam is a polyacrylate. Antifoams may be present in the composition from 0.001 to 0.012 or 0.004 wt % or even 0.001 to 0.003 wt %.

Demulsifiers

The compositions of the invention may also include demulsifiers, which are known in the art and include but are not limited to derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include polyethylene glycols, polyethylene oxides, polypropylene oxides, (ethylene oxide-propylene oxide) polymers and mixtures thereof. In some embodiments the demulsifiers are polyethers. Demulsifiers may be present in the composition from 0.002 to 0.2 wt %.

Pour Point Depressants

Pour point depressants are known in the art and include but are not limited to esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

Rust Inhibitor

The compositions of the present technology may also include a rust inhibitor. Suitable rust inhibitors include hydrocarbyl amine salts of dialkyldithiophosphoric acid, hydrocarbyl amine salts of hydrocarbyl arenesulphonic acid and fatty carboxylic acids or esters thereof, an ester of a nitrogen-containing carboxylic acid, an ammonium sulfonate, an imidazoline, mono-thio phosphate salts or esters, or any combination thereof; or mixtures thereof.

Examples of hydrocarbyl amine salts of dialkyldithiophosphoric acid of the technology include but are not limited to the reaction product(s) of diheptyl or dioctyl or dinonyl dithiophosphoric acids with ethylenediamine, morpholine or Primene™ 81R or mixtures thereof.

Suitable hydrocarbyl amine salts of hydrocarbyl arenesulphonic acids used in the rust inhibitor package of the technology are represented by the formula:

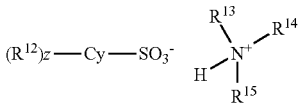

(V)

wherein Cy is a benzene or naphthalene ring; $R^{12}$ is a hydrocarbyl group with about 4 to about 30, preferably about 6 to about 25, more preferably about 8 to about 20 carbon atoms; z is independently 1, 2, 3, or 4 and most preferably z is 1 or 2; and $R^{13}$, $R^{14}$ and $R^{15}$ are independently hydrogen, alkyl branched or linear alkyl chains with about 1 to about 30, in other embodiments about 4 to about 24, or even from about 6 to about 20, and in some embodiments about 8 or 10 to about 16 carbon atoms. In some embodiments, $R^{13}$, $R^{14}$ and $R^{15}$ are independently hydrogen, alkyl branched or linear alkyl chains, and in some embodiments at least one, or even two of $R^{13}$, $R^{14}$ and $R^{15}$ are hydrogen, and further where at least one of $R^{13}$, $R^{14}$ and $R^{15}$ is a hydrocarbyl group containing at least 8 carbon atoms. Examples of hydrocarbyl amine salts of hydrocarbyl arenesulphonic acid of the technology include but are not limited to the ethylenediamine salt of dinonylnaphthalene sulfonic acid. Examples of suitable fatty carboxylic acids or esters thereof include glycerol monooleate and oleic acid.

An example of a suitable ester of a nitrogen-containing carboxylic acid includes oleyl sarcosine. The rust inhibitors may be present in the range from 0.001 to 1.0 wt %, or 0.02 to 0.2, from 0.03 to 0.15, from 0.04 to 0.12, or from 0.05 to 0.1 wt % of the industrial gear lubricant. The rust inhibitors of the present technology may be used alone or in mixtures thereof.

Metal Deactivator

The compositions of the present technology may also include a metal deactivator. Metal deactivators are used to neutralise the catalytic effect of metal for promoting oxidation in the industrial gear lubricant. Suitable metal deactivators include but are not limited to triazoles, tolyltriazoles, a thiadiazole, or combinations thereof, as well as derivatives thereof. Examples include derivatives of benzotriazoles, benzimidazole, 2-alkyldithiobenzimidazoles, 2-alkyldithiobenzothiazoles, 2-(N,N'-dialkyldithio-carbamoyl)benzothiazoles, 2,5-bis(alkyl-dithio)-1,3,4-thiadiazoles, 2,5-bis(N,N'-dialkyldithiocarbamoyl)-1,3,4-thiadiazoles, 2-alkyldithio-5-mercapto thiadiazoles or mixtures thereof. These additives may be used from 0.01 to 0.25 wt % in the overall composition. In some embodiments the metal deactivator is a hydrocarbyl substituted benzotriazole compound. The benzotriazole compounds with hydrocarbyl substitutions include at least one of the following ring positions 1- or 2- or 4- or 5- or 6- or 7-benzotriazoles. The hydrocarbyl groups contain about 1 to about 30, preferably about 1 to about 15, more preferably about 1 to about 7 carbon atoms, and most preferably the metal deactivator is 5-methylbenzotriazole used alone or mixtures thereof. The metal deactivators may be present in the range from 0.001 to 0.5, from 0.01 to 0.04 or from 0.015 to 0.03 wt % of the industrial gear lubricant. Metal deactivators may also be present in the composition from 0.002 or 0.004 to 0.02 wt %. The metal deactivator may be used alone or mixtures thereof.

Antioxidant

Antioxidants may also be present including (i) an alkylated diphenylamine, and (ii) a substituted hydrocarbyl mono-sulfide. In some embodiments the alkylated diphenylamines of the technology are bis-nonylated diphenylamine and bis-octylated diphenylamine. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide is 1-(tert-dodecylthio)-2-propanol. The antioxidant may also include sterically hindered phenols. Examples of suitable hydrocarbyl groups for the sterically hindered phenols include but are not limited to 2-ethylhexyl or n-butyl ester, dodecyl or mixtures thereof. Examples of methylene-bridged sterically hindered phenols include but are not limited to 4,4'-methylene-bis(6-tert-butyl o-cresol), 4,4"-methylene-bis(2-tert-amyl-o-cresol), 2,2'-methylene-bis(4-methyl-6-tert-butylphenol), 4,4'-methylene-bis(2,6-di-tertbutylphenol) or mixtures thereof. The antioxidants may be present in the composition from 0.01 wt % to 6.0 wt %, or from 0.02 wt % to 1 wt %. The additive may be present in the composition at 1 wt %, 0.5 wt %, or less.

Extreme Pressure Agent

The compositions of the invention may also include sulfur-containing compounds. Suitable sulfur-containing compounds include sulfurized olefins and polysulfides. The sulfurized olefin or polysulfides may be derived from isobutylene, butylene, propylene, ethylene, or some combination thereof. In some examples, the sulfur-containing compound is a sulfurized olefin derived from any of the natural oils or synthetic oils described above, or even some combination thereof. For example, the sulfurized olefin may be derived from vegetable oil. The extreme pressure agent may be present in the lubricant composition at a range of 0 to 5 wt %, or 0.01 to 4 wt %, 0.1 to 3 wt %, based on a total weight of the lubricant composition.

Viscosity Modifier

One component frequently used is a viscosity modifier. Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers.

As used herein the expression "(meth)acrylic," (meth)acrylate," and related terms is intended to encompass both acrylic functionality as well as methacrylic functionality. Typically, the "(meth)acrylic," (meth)acrylate," and related terms is intended to include a methacrylic or methacrylate.

In one embodiment, a lubricating composition as described herein may contain 0.1 wt % to 5 wt % (or 0.5 wt % to 4 wt %) of a linear polymer having dispersant functionality. The linear polymer may have a weight average molecular weight of 5,000 to 25,000, or 8000 to 20,000. (All weight average molecular weights are by GPC using polystyrene standards with weight average molecular weights ranging from 350 to 2,000,000.) In one embodiment the linear polymer may include a poly(meth)acrylate or mixtures thereof. The linear polymer may be present in the compositions at 0.1 wt % to 5 wt %, or 0.1 wt % to 4 wt %, or 0.2 wt % to 3 wt %, or 0.5 wt % to 3 wt %, 0.5 wt % to 4 wt % of the lubricating composition.

The linear polymer may have, in certain embodiments, a composition that comprises a poly(meth)acrylate polymer derived from a monomer composition comprising: (a) 50 wt % to 95 wt %, or 60 wt % to 80 wt % of an alkyl (meth)acrylate, wherein the alkyl group of the (meth)acrylate has 10 to 15 carbon atoms; (b) 1 wt % to 40 wt %, or 4 wt % to 35 wt % of an alkyl (meth)acrylate, wherein the alkyl group of the (meth)acrylate has 1 to 9 carbon atoms; (c) 1 wt % to 10 wt %, or 1 wt % to 8 wt % of a dispersant monomer, (d) 0 wt % to 4 wt %, or 0 wt % to 2 wt %, or 0 wt % of a vinyl aromatic monomer (typically styrene); and (e) 0 wt % to 9 wt %, or 0 wt % to 6 wt % of an alkyl (meth)acrylate, wherein the alkyl group of the (meth)acrylate has 16 to 18 carbon atoms. In one embodiment the linear polymer may contain 0 wt % to 20 wt % of 16 to 18 alkyl (meth)acrylate.

Dispersant monomers which may be present are often nitrogen-containing monomers. The nitrogen-containing monomer may include a vinyl-substituted nitrogen heterocyclic monomer, a dialkylaminoalkyl (meth)acrylate monomer, a dialkylaminoalkyl (meth)acrylamide monomer, a tertiary-(meth)acrylamide monomer, ureido (meth)acrylate. Some examples include N,N-dimethylacrylamide, N-vinyl carbonamides such as N-vinyl-formamide, vinyl pyridine, N-vinylacetoamide, N-vinyl-n-propionamides, N-vinyl hydroxyacetoamide, N-vinyl imidazole, N-vinyl pyrrolidinone, N-vinyl caprolactam, dimethylaminoethyl acrylate (DMAEA), dimethylaminoethyl(meth)acrylate (DMAEMA), dimethylaminobutylacrylamide, dimethylamino-propyl(meth)acrylate (DMAPMA), dimethylamine-propyl acrylamide, dimethylaminopropyl methacrylamide, dimethylaminoethyl acrylamide, or mixtures thereof. A dispersant monomer may also be oxygen-containing compound. The oxygen-containing compound may include hydroxyalkyl (meth)acrylates such as 3-hydroxypropyl (meth)acrylate, 3,4-dihydroxybutyl (meth)acrylate, 2-hydroxyethyl (meth)acrylate, 2-hydroxypropyl (meth)acrylate, 2,5-dimethyl-1,6-hexanediol (meth)acrylate, 1,10-decanediol (meth)acrylate, carbonyl-containing (meth)acrylates such as 2-carboxyethyl (meth)acrylate, carboxymethyl (meth)acrylate, oxazolidinylethyl (meth)acrylate, N-(methacryloyloxy)formamide, acetonyl (meth)acrylate, N-methacryloylmorpholine, N-methacryloyl-2-pyrrolidinone, N-(2-methacryloyloxyethyl)-2-pyrrolidinone, N-(3-methacryloyloxypropyl)-2-pyrrolidinone, N-(2-methacryloyloxypentadecyl)-2-pyrrolidinone, N-(3-methacryloyloxyheptadecyl)-2-pyrrolidinone; glycol di(meth)acrylates such as ethylene glycol di(meth)acrylate, 1,4-butanediol (meth)acrylate, 2-butoxyethyl (meth)acrylate, 2-ethoxyethoxymethyl (meth)acrylate, 2-ethoxyethyl (meth)acrylate, or mixtures thereof. The linear polymer of this type is described in more detail in U.S. Pat. No. 6,124,249, or EP 0 937 769 A1 paragraphs [0019] and [0031] to [0067].

Another viscosity modifying polymer that may be present is a star polymer. In one embodiment the lubricating composition of the invention includes a viscosity modifier comprises a star polymer and linear polymer described herein. The star polymer may be derived from a monomer composition comprising $C_{12-15}$ alkyl (meth)acrylate (about 80 wt %), and about 20 wt % of a mixture of monomers composed of methyl (meth)acrylate, 2-ethylhexyl (meth)acrylate, and ethylene glycol di(meth)acrylate. A detailed description of the star polymer disclosed herein may also be described in WO 2007/127660 (published on Nov. 8, 2007, by Baker et al. and assigned to The Lubrizol Corporation), paragraphs [0021] to [0061]. Baker discloses composition and methods of preparation of a variety of star polymers.

A (meth)acrylic polymer having star architecture may have three or more arms that comprise a poly(meth)acrylate polymer, which may be derived from a monomer composition comprising: (a) 50 wt % to 100 wt % of an alkyl (meth)acrylate, wherein the alkyl group of the (meth)acrylate has 12 to 15 carbon atoms; (b) 0 wt % to 40 wt % of an alkyl (meth)acrylate, wherein the alkyl group of the (meth) acrylate has 1 to 9 carbon atoms; (c) 0 wt % to 10 wt % of a dispersant monomer (as described above), (d) 0 wt % to 5 wt %, or 0 wt % to 2 wt %, or 0 wt % of a vinyl aromatic monomer (typically styrene); and (e) 0 wt % to 20 wt %, or 0 wt % to 10 wt %, or 0 wt % of an alkyl (meth)acrylate, wherein the alkyl group of the (meth)acrylate has 16 to 18 carbon atoms.

The star polymer may have a weight average molecular weight of 100,000 to 1,300,000, or 125,000 to 1,000,000, or 150,000 to 950,000, or 200,000 to 800,000.

As used herein the shear stability index (SSI) of the star polymer may be determined by a 20-hour KRL test (Volkswagen Tapered Bearing Roller Test). The test procedure is set out in both CEC-L-45-99 or equivalent test method DIN 51350-6-KRL/C. The star polymer SSI may be in the range of 0 to 100, or 0 to 80, or 0 to 60, or 0 to 50, 0 to 20, or 0 to 15, or 0 to 10, or 0 to 5. An example of a suitable range for the SSI includes 1 to 5, 10 to 25, or 25 to 65.

The star polymer may be a homopolymer or a copolymer, that is, its arms may be homopolymeric or copolymeric (i.e., containing two or more monomer types). In one embodiment the star polymer may be a copolymer. The star polymer may be a star polymer having a random, tapered, di-block, tri-block or multi-block architecture. Typically, the star polymer has random or tapered architecture.

The star polymer may be obtained/obtainable from a controlled radical polymerization technique. Examples of a controlled radical polymerization technique include RAFT, ATRP or nitroxide mediated processes. The star polymer may also be obtained/obtainable from anionic polymerization processes. In one embodiment the star polymer may be obtained/obtainable from RAFT, ATRP or anionic polymerization process. In one embodiment the star polymer may be obtained/obtainable from RAFT or ATRP polymerization process. In one embodiment the star polymer may be obtained/obtainable from a RAFT polymerization process. Methods of preparing polymers using ATRP, RAFT or nitroxide-mediated techniques are disclosed in the example section of International Publication WO 2006/047398, see examples 1 to 47.

The star polymers may be prepared by techniques known in the art to prepare either core-first or arm-first approaches. Typically, the star polymer is prepared by an "arm-first" approach using RAFT or ATRP (typically RAFT) polymerization techniques.

Some commercially available VMs and DVMs include polyisobutylenes (such as Indopol™ from BP Amoco or Parapol™ from ExxonMobil); olefin copolymers (such as Lubrizol® 7060, 7065, and 7067, and Lucant® HC-2000, HC-1100, and HC-600 from Lubrizol); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improvers from Afton, and LZ® 7702, LZ® 7727, LZ® 7725 and LZ® 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 50% or to 20% by weight, depending on the application. Concentrations of 1 to 20%, or 1 to 12%, or 3 to 10%, or alternatively 20 to 40%, or 20 to 30% by weight may be used. The viscosity and or dispersant modifier may be added to an oil of lubricating viscosity to form a finished lubricant having a kinematic viscosity ranging from 60 to 1000 cSt ($mm^2/s$) for industrial gear oils.

Friction Modifier

Another component that may be used in the present composition is a friction modifier. Friction modifiers are well known to those skilled in the art and include such materials as fatty phosphites, fatty acid amides, fatty epoxides, borated fatty epoxides, fatty amines, glycerol esters, borated glycerol esters, alkoxylated fatty amines, borated alkoxylated fatty amines, metal salts of fatty acids, sulfurized olefins, fatty imidazolines, condensation products of carboxylic acids and polyalkylene-polyamines, metal salts of alkyl salicylates, amine salts of alkylphosphoric acids, and mixtures thereof. Representatives of each of these types of friction modifiers are known and are commercially available and are described in greater detail in US-2006-0172899.

Among the amine friction modifiers described in the above U.S. Application are tertiary amines of the general structure $R^1R^2NR^3$ where $R^3$ can be a polyol-containing alkyl group (that is, a group containing 2 or more hydroxy groups) or a group containing one or more hydroxy groups and one or more amine groups. For instance, $R^3$ may be —$CH_2$—CHOH—$CH_2OH$ or a homologue thereof, containing, for example, 3 to 8 carbon atoms or 3 to 6 carbon atoms or 3 to 4 carbon atoms, and 2, 3, 4 or more hydroxy groups (normally no more than one hydroxy group per carbon atom). A typical resulting product may thus be represented by $$R^1R^2N—CH_2—CHOH—CH_2OH$$

or homologues thereof, where $R^1$ and $R^2$ are independently alkyl groups of 8 to 20 carbon atoms. Such products may be obtained by the reaction of a dialkyl amine with an epoxide or chlorohydroxy compound. For example, reaction of a secondary amine with glycidol (2,3-epoxy-1-propanol) or "chloroglycerine" (that is, 3-chloropropane-1,2-diol) may be effective. Such materials based on the reaction of dicocoamine with one or more moles of glycidol or chloroglycerine are useful in providing friction-modifying performance. If reaction is with multiple moles of glycidol or chloroglycerine, or other epoxyalkanols or chlorodiols, a dimeric or oligomeric ether-containing group, that is, a hydroxyl-substituted alkoxyalkyl group, may result.

Another friction modifier may be an amide represented by the structure $R_3$—C(=O)—$NR^1R^2$ wherein $R^1$ and $R^2$ are each independently hydrocarbyl groups of at least 6 carbon atoms, such as 6 to 24 carbon atoms, and $R^3$ is a hydroxyalkyl group of 1 to 6 carbon atoms. Such a material may be prepared from the reaction of a carboxylic acid or a reactive equivalent thereof with an amino alcohol. Examples include the reaction product of isostearic acid or an alkyl succinic anhydride with tris-hydroxymethylaminomethane. Such friction modifiers are described in greater detail in U.S. Pat. No. 7,381,691, Adams et al., Jun. 3, 2008.

In certain embodiments the lubricant composition may contain a friction modifier component which comprises (α) an N-substituted oxalic acid bisamide or amide-ester containing at least two hydrocarbyl groups of about 12 to about 22 carbon atoms; or (β) a condensation product of (i) an aromatic polycarboxylic acid or mixtures thereof or a reactive equivalent thereof, having at least two carboxylic groups situated so as to permit formation of a cyclic imide having 5 or 6 atoms in said cyclic structure; with (ii) an aliphatic primary amine or alcohol containing about 6 to about 80 carbon atoms; or both (α) and (β). The presence of one or more of such friction modifiers (α) or (β) may impart good friction performance to a driveline device such as an automatic transmission.

The component described as (α) This component may be, when in the form of the bisamide, may be represented by the formula

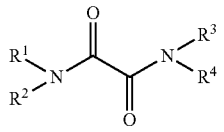

In this structure at least two of the Rs are independently groups comprising a hydrocarbyl group of 1 to 22 carbon atoms and up to two of the R groups are hydrogen or a hydrocarbyl group of 10 or fewer carbon atoms. In other embodiments, one or more of the R groups may independently contain 12 to 20 or 12 to 18 or 12 to 16 or 12 to 14 or 14 to 20 or 14 to 18 or 14 to 16 carbon atoms. If there are two hydrocarbyl groups of 12 to 22 carbon atoms, they may be both on the same nitrogen or they may be on different nitrogen atoms; that is, either $R^3$ and $R^4$ or alternatively $R^1$ and $R^4$ may be hydrogen. The hydrocarbyl groups may be the same or different within a given molecule or within a mixture of molecules in the overall composition.

Since at least two of the groups $R^1$, $R^2$, $R^3$ and $R^4$ in the above structure comprise a hydrocarbyl group of 12 to 22 carbon atoms, such groups may be such a hydrocarbyl group, for instance, an alkyl group of 12 to 22 carbon atoms. Alternatively, such groups may comprise such a hydrocarbyl group as a part of a larger structure. That is, such groups may have the general structure such as $R^5R^6N—R^9$— where one or both of the $R^5$ and $R^6$ are hydrocarbyl groups of 12 to 22 carbons and optionally one of the $R^5$ and $R^6$ may be hydrogen or a shorter hydrocarbyl group. $R^9$ would be a hydrocarbylene linking group, such as methylene, ethylene, propylene, or butylene, and in some cases a 1-3-propylene group.

In some embodiments, therefore, the substituted oxalic acid bisamide may comprise a material of the structure about in which two of the groups $R^1$, $R^2$, $R^3$, and $R^4$ are independently alkyl groups of about 12 to about 22 carbon atoms. Such materials may have a structure such as

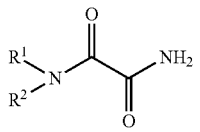

wherein each $R^1$ and $R^2$ is independently an alkyl group of about 12 to about 18 carbon atoms. Such a material may be obtained or obtainable by known methods such as the process of reacting a dialkylamine with an alkyl oxamate such as ethyl oxamate.

In another embodiment, the N-substituted oxalic acid bisamide or amide-ester of (α) comprises an amide-ester represented by the formula:

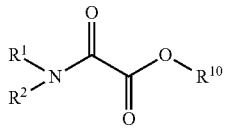

In this embodiment, $R^1$ and $R^2$ may independently be hydrocarbyl groups of 12 to 22 carbon atoms, as defined elsewhere herein, and $R^{10}$ may be a hydrocarbyl group of 1 to 22 carbon atoms. n certain embodiments, $R^{10}$ is methyl, ethyl, n-propyl, isopropyl, n-butyl, sec-butyl, isobutyl, or t-butyl.

In certain embodiments the friction modifier (α) may be represented by the formula:

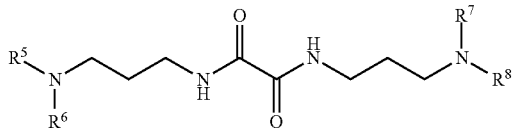

wherein $R^5$ and $R^7$ are independently a hydrocarbyl group of about 12 to about 22 carbon atoms and $R^6$ and $R^8$ are independently hydrogen or a hydrocarbyl group of or fewer carbon atoms or a hydrocarbyl group of about 12 to about 22 carbon atoms. Diamines suitable for preparing such products include those in the "Duomeen" series, available from Akzo, having a general structure such as

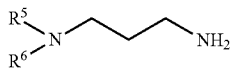

These and other friction modifiers designated herein as (α) are described in greater detail in U.S. Pat. No. 8,691,740, Vickerman et al., Apr. 8, 2014.

With regard to the friction modifier labeled as (β), the aromatic polycarboxylic acid or reactive equivalent thereof may be a diacid, a triacid, a tetraacid, or a higher acid (or reactive equivalents). If the reaction product is a monoimide, the polycarboxylic acid will contain at least two acid (or equivalent) groups. If the reaction product is a diimide, the polycarboxylic acid will contain at least four acid (or equivalent) groups. The acid groups are situated so as to permit (but not require) formation of a 5-membered or 6-membered cyclic imide, which means that they may be, for instance, in positions ortho to each other on an aromatic ring.

Reactive equivalents of carboxylic acids include acids, esters, acid halides such as acid chlorides, and anhydrides. For their ready availability and ease of reaction, anhydrides, especially cyclic anhydrides, are often used. The condensation products of the (β) component may have, but will not necessarily have, a cyclic imide structure: they may comprise, for instance, an ester or an amide group or an imidazoline group.

The carboxylic acid groups may be attached directly to an aromatic group, or they may be indirectly attached through intervening carbon atoms. An example of a material of the latter sort would be an aromatic ring substituted by at least one succinic acid (or anhydride) group, with other ring substituents also optionally present, such as phenylsuccinic acid or anhydride.

The amount of the friction modifier, whether as an individual component or as a mixture of individual friction modifiers, may be 0.1 to 5 weight percent, or 0.2 to 2 weight percent, or 0.4 to 1.5 weight percent.

Compatibilizers

The compositions of the invention may include a compatibilizer or solubilizer to improve the solubility of polar additives and sludge. In some embodiments, the compatibilizer may include esters or alkylated naphthalenes. Esters may include esters of dibasic acids with monoalkanols and the polyol esters of monocarboxylic acids. Esters of the former type include, for example, the esters of dicarboxylic acids such as phthalic acid, succinic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols; e.g., neopentyl glycol, trimethylol ethane, 2-methyl-2-propyl-1,3-propanediol, trimethylol propane, pentaerythritol and dipentaerythritol with alkanoic acids containing at least 4 carbon atoms, preferably $C_5$ to $C_{30}$ acids such as saturated straight chain fatty acids including caprylic acid, capric acids, lauric acid, myristic acid, palmitic acid, stearic acid, arachic acid, and behenic acid, or the corresponding branched chain fatty acids or unsaturated fatty acids such as oleic acid, or mixtures of any of these materials.

In some embodiments, the compatibilizer may include one or more saturated alcohols. Suitable compatibilisers include linear and branched saturated alcohols, however in some embodiments the compatibiliser includes one or more branched saturated alcohols. In some embodiments, the compatibiliser is essentially free or, or even completely free of, linear saturated alcohols.

In some embodiments, the compatibiliser includes a branched, primary, saturated alcohol. In some embodiments, the compatibiliser is essentially free or, or even completely free of, unsaturated alcohols. In some embodiments, the compatibiliser is essentially free or, or even completely free of, secondary alcohols.

In some embodiments, the compatibiliser includes one or more a Guerbet alcohols. Guerbet alcohols may be described as alcohols made via the Guerbet reaction, which was named after Marcel Guerbet. In a Guerbet reaction, a primary aliphatic alcohol is converted to its β-alkylated dimer alcohol (i.e., a branched, primary, saturated alcohol).

In some embodiments, the compatibiliser includes at least one compound with the structure: $HO—CH_2—(R^1)_n—CR^2R^3R^4$ where $R^1$ is a alkylene group containing from 1 to 20 carbon atoms, n is either 0 or 1, and each of $R^2$, $R^3$ and $R^4$ are independently hydrogen or alkyl groups containing from 1 to 20 carbon atoms. In some embodiments, n is zero, and $R^2$ and $R^3$ are alkyl groups, and $R^4$ is hydrogen. In such embodiments, $R^2$ and $R^3$ may contain from 4 to 14, or even from 6 to 12 carbon atoms. In still further embodiments, $R^2$ and $R^3$ contain 6 and 8, or 10 and 12 carbon atoms.

Suitable examples of the compatibilisers useful in the invention include 2-ethylhexanol, 2-butyloctanol, 2-hexyldecanol, 2-octyldodecanol, 2-decyltetradecanol, 2-dodecylhexadecanol, or any combination thereof. These types of alcohols are commercially available from Sasol and marketed as ISOFOL alcohols.

In some embodiments, the compatibiliser includes 2-hexyldecanol, 2-decyltetradecanol, or any combination thereof. In some embodiments, the compatibiliser includes 2-hexyldecanol. In some embodiments, the compatibiliser includes 2-decyltetradecanol.

The compatibiliser may be present in the industrial lubricant composition at 2 percent by weight or more. In some embodiments, the compatibiliser is present from 2 to 20 or even 2 to 10 percent by weight in the industrial lubricant composition.

Multifunctional Materials

Other optional materials include a variety of compounds that may exhibit a variety of performance benefits including friction modification (especially, friction reduction), antiwear performance, or other benefits. Such materials are the compounds are generally obtained or obtainable by a process comprising reacting a hydroxy acid with at least one member selected from the group consisting of an amine, an alcohol, and an aminoalcohol. The product may comprise an ester, an amide, or an imide. Examples include oleyl tartrimide (the imide formed from oleylamine and tartaric acid) and oleyl diesters (from, e.g., mixed $C_{12}$-$C_{16}$ alcohols). Other related materials that may be useful include esters, amides, and imides of other hydroxy-carboxylic acids in general, including hydroxy-polycarboxylic acids, for instance, acids such as tartaric acid, citric acid, lactic acid, malic acid, glycolic acid, hydroxy-propionic acid, hydroxyglutaric acid, and mixtures thereof. These materials are described in greater detail in US Publication 2006-0079413 and PCT publication WO2010/077630. Such derivatives of (or compounds derived from) a hydroxy-carboxylic acid, if present, may typically be present in the lubricating composition in an amount of 0.1 weight % to 5 weight %, or 0.2 weight % to 3 weight %, or greater than 0.2 weight % to 3 weight %.

Another optional material may be an ester of a polyacid, e.g., of a diacid, such as a dialkyl adipate, e.g., di-tridecyl adipate. Such an ester may provide performance as a solubilizer or a seal swell agent. If present, its amount may be 0.01 to 2 percent by weight, or 0.05 to 1.5, or 0.1 to 1.0, or 0.3 to 0.8 weight percent.

Other optional materials include antioxidants, that is, oxidation inhibitors, including hindered phenolic antioxidants, secondary aromatic amine antioxidants such as dinonyldiphenylamine as well as such well-known variants as monononyldiphenylamine and diphenylamines with other alkyl substituents such as mono- or di-octyl, sulfurized phenolic antioxidants, oil-soluble copper compounds, phosphorus-containing antioxidants, and organic sulfides, disulfides, and polysulfides such as 2-hydroxyalkyl, alkyl thioethers or 1-t-dodecylthio-2-propanol or sulfurized 4-carbobutoxycyclohexene or other sulfurized olefins. In one embodiment, the antioxidant may be an amine antioxidant which may be a phenyl-α-naphthylamine (PANA) or a hydrocarbyl substituted diphenylamine, or mixtures thereof. The hydrocarbyl substituted diphenylamine may include mono- or di-$C_4$ to $C_{16}$-, or $C_6$ to $C_{12}$-, or $C_9$-alkyl diphenylamine. For example, the hydrocarbyl substituted diphenylamine may be octyl diphenylamine, or di-octyl diphenylamine, dinonyl diphenylamine, typically dinonyl diphenylamine. In one embodiment the antioxidant may be a hindered phenol antioxidant. Such materials often contain a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba, or butyl 3-(3,5-di-tert-butyl-4-hydroxyphenyl)propanoate.

When present, the antioxidant may be present at 0.1 wt % to 1.2 wt %, or 0.2 to 1 wt %, or 0.3 wt % to 1.0 wt %, or 0.4 wt % to 0.9 wt %, or 0.5 wt % to 0.8 wt %, of the lubricating composition.

Other optional components include seal swell compositions, such as isodecyl sulfolane or phthalate esters, which are designed to keep seals pliable. Also permissible are pour point depressants, such as alkylnaphthalenes, polymethacrylates, vinyl acetate/fumarate or/maleate copolymers, and styrene/maleate copolymers. Another material is an antiwear agent such as zinc dialkyldithiophosphates. Another optional material may be a $C_8$ to $C_{20}$ alkyl amine salt of a mono- or di-alkyl phosphate or thiophosphate ester, which may be present in an amount to provide 100 to 2000 parts per million by weight of phosphorus to the lubricant composition. These optional materials are known to those skilled in the art, are generally commercially available, and are described in greater detail in published European Patent Application 761,805. Another material which may be present is a borate ester such as a trialkyl borate, which may be useful to as an extreme pressure/antiwear agent. The alkyl groups thereof may contain 4 to 12 carbon atoms, or 6 to 10 carbon atoms, or 8 carbon atoms. In one embodiment the trialkyl borate comprises tri(2-ethylhexyl) borate. The amount of the alkyl borate, if present, may be 0.1 to 1 weight percent or 0.2 to 0.7 weight percent or 0.3 to 0.4 weight percent. Also included can be known materials such as corrosion inhibitors (e.g., tolyltriazole, dimercaptothiadiazoles), dyes, fluidizing agents, odor masking agents, and antifoam agents. Organic borate esters and organic borate salts can also be included.

Other components that may be present include various sulfur-containing materials such as dimercaptothiadiazoles and derivatives thereof that may serve as corrosion inhibitor, metal deactivator, or rust inhibitor. One specific material is 2,5-dimercapto-1,3,4-thiadiazole (DMTD); derivatives thereof are often used. Derivatives of DMTD include: (a)

2-hydrocarbyldithio-5-mercapto-1,3,4-thiadiazole or 2,5-bis-(hydrocarbyldithio)-1,3,4-thiadiazole and mixtures thereof, such as 1,3,4-thiadiazole, 2,5-bis(tert-nonyldithio); (b) carboxylic esters of DMTD; (c) condensation products of .alpha.-halogenated aliphatic monocarboxylic acids with DMTD; (d) reaction products of unsaturated cyclic hydrocarbons and unsaturated ketones with DMTD; (e) reaction products of an aldehyde and a diaryl amine with DMTD; (f) amine salts of DMTD; (g) dithiocarbamate derivatives of DMTD; (h) reaction products of an aldehyde, and an alcohol or aromatic hydroxy compound, and DMTD; (i) reaction products of an aldehyde, a mercaptan and DMTD; (j) 2-hydrocarbylthio-5-mercapto-1,3,4-thiadiazole; and (k) products from combining an oil soluble dispersant with DMTD; and mixtures thereof. Compositions a)-k) are described in U.S. Pat. No. 4,612,129. Suitable amounts of DMTD may include 0.01 to 15 weight percent, 0.02 to 10, 0.05 to 5, and 0.1 to 3 weight percent.

The above components can be in the form of a fully formulated lubricant or in the form of a concentrate within a smaller amount of lubricating oil. If they are present in a concentrate, their concentrations will generally be directly proportional to their concentrations in the more dilute form in the final blend.

The above-described lubricant compositions may be used for lubricating a mechanical device, by supplying thereto the lubricant. The mechanical devices which may benefit from the present lubricant are not particularly limited but may include internal combustion engines (including gasoline or diesel fueled or mixed fuel engine or hybrid engines), gears, hydraulic systems, and transmissions, including automatic transmissions, manual transmissions, and variants thereof such as dual clutch transmissions and continuously variable transmissions, including push-belt transmissions and traction drives.

Industrial Gear

The disclosed lubricant compositions can contain further additive components suitable for industrial gear lubricants. Any combination of conventional additive components suitable for use in industrial gear applications may be used, including the other materials described above.

The further additive components which may be present in the industrial gear additive package in addition to the novel phosphonate esters described above include, but are not limited to, foam inhibitors, demulsifiers, pour point depressants, antioxidants, dispersants, metal deactivators (such as copper deactivators), other phosphorus-containing antiwear agents, viscosity modifiers, extreme pressure agents, or some mixture thereof. These additives may each be present in the range from 50, 75, 100 or even 150 ppm up to 5, 4, 3, 2 or even 1.5 wt %, or from 75 ppm to 0.5 wt %, from 100 ppm to 0.4 wt %, or from 150 ppm to 0.3 wt %, where the wt % values are with regards to an individual component in respect of a fully formulated industrial gear lubricant. However, it is noted that some additives, including viscosity modifying polymers, which may alternatively be considered as part of the base fluid of lubricating viscosity, may be present in higher amounts including up to 30, 40, or even 50% by weight when considered separate from the oil of lubricating viscosity. The additives may be used alone or as mixtures thereof.

The disclosed compositions may also include one or more antiwear additives and/or extreme pressure agents, one or more rust and/or corrosion inhibitors, one or more foam inhibitors, one or more demulsifiers, or any combination thereof.

In some embodiments, the industrial lubricant additive packages, or the resulting industrial lubricant compositions, are essentially free of or even completely free of phosphorous amine salts, dispersants, or both.

In some embodiments, the industrial lubricant additive packages, or the resulting industrial lubricant compositions, include a demulsifier, a corrosion inhibitor, a friction modifier, or combination of two or more thereof. In some embodiments, the corrosion inhibitor includes a tolyltriazole. In still other embodiments, the industrial additive packages, or the resulting industrial lubricant compositions, include one or more sulfurized olefins or polysulfides; one or more phosphorus amine salts; one or more thiophosphate esters, one or more thiadiazoles, tolyltriazoles, polyethers, and/or alkenyl amines; one or more ester copolymers; one or more carboxylic esters; one or more succinimide dispersants, or any combination thereof.

In some embodiments the industrial gear additive packages include one or more phosphorus amine salts, but in amounts such that the additive package, or in other embodiments the resulting industrial gear lubricant compositions, contains no more than 1.0 wt % of such materials, or even no more than 0.75 or 0.6 wt %. In other embodiments the industrial gear additive packages, or the resulting industrial gear lubricant compositions, are essentially free of or even completely free of phosphorus amine salts.

In one embodiment, the present technology can include a three-part mixture of a phosphate amine salt, a phosphate, and a phosphite.

In some embodiments the industrial gear additive packages, or the resulting industrial gear lubricant compositions, include a demulsifier, a corrosion inhibitor, a friction modifier, or combination of two or more thereof. In some embodiments the corrosion inhibitor includes a tolyltriazole. In still other embodiments the industrial gear additive packages, or the resulting industrial gear lubricant compositions, include one or more polysulfides; one or more phosphate amine salts; one or more thiophosphate esters, one or more thiadiazoles, tolyltriazoles, polyethers, and/or alkenyl amines; one or more ester copolymers; one or more carboxylic esters; one or more succinimide dispersants, or any combination thereof.

The industrial gear lubricant additive package can be admixed with an oil of lubricating viscosity to prepare an industrial gear lubricant that meets or exceeds the standards for environmental friendliness while providing equivalent or improved industrial gear lubricant performance. The oil of lubricating viscosity can be present in a major amount, for a lubricant composition, or in a concentrate forming amount, for a concentrate and/or additive composition. The oil of lubricating viscosity may be biodegradable or non-biodegradable.

In the industrial gear lubricants: the oil of lubricating viscosity, may be present from 80, 85, 90, 95, 97 or even 97.5 or 98 wt % oil up to 90, 95, 97, 97.5, or even 98 wt %; and the industrial gear lubricant additive package, may be present from 1, 1.5, or even 2 wt % up to 2, 3, 4, 5, 7 or even 10 wt %.

In a concentrate of the industrial gear additive: the oil of lubricating viscosity, may be present from 1, 5, even 10 wt % oil up to 10, 20, 30, 40, or even 45 or 49 wt %; and the industrial gear lubricant additive package, may be present from 20, 25, 25.5, 27.5, 30, 35, 45 or even 45 wt % up to 45, 47.5, or even 49.5 wt %.

The industrial gear lubricant of the present technology can meet the performance requirements required of an industrial gear lubricant, as well as standards set for environmental friendliness.

Industrial gear oils (IGOs) must maintain a specified level of performance in the typical bench tests that have been part of well-known industrial gear approvals like USS 224, AGMA 9005-D94, recently replaced by AGMA 9005-E02, DIN 51517-3:2009-06, Fives Cincinnati, etc. With respect to antiwear/extreme pressure performance, the bench tests include, for example, ASTM D2783 Standard Test Method for Measurement of Extreme-Pressure Properties of Lubricating Fluids (Four-Ball Method), Standard Test Method for Measurement of Extreme-Pressure Properties of Lubricating Fluids (Timken Method) (ASTM D2782). Other tests include ASTM D4172 Standard Test Method for Wear Preventive Characteristics of Lubricating Fluid, FZG Scuffing (DIN ISO 14635-1) or ASTM D5182 Standard Test Method for Evaluating the Scuffing Load Capacity of Oils (FZG Visual Method), Copper Corrosion Protection (ASTM D130, ISO 2160), Oxidation Control (ASTM D2893, DIN EN ISO 4263-4, S-200), Rust Prevention (ASTM D665, ISO 7120), Static Seal Compatibility (DIN EN ISO 1817), Demulsibility (ASTM D2711, ASTM D1401, ISO 6614), Foam Control (ASTM D892, ISO 6247), etc. The stability properties of the lubricant can be measured using D1401 Standard Test Method for Water Separability of Petroleum Oils and Synthetic Fluids.

In some embodiments, the lubricant may have a Timken rating as measured using D2782 of greater than 45 pounds. In the same or alternate embodiments, the lubricant composition may have a 4-ball weld point of at least 200 kilograms-force and a load wear index of at least 45 kilograms-force as measured using D2783.

The disclosed technology includes methods of making the industrial gear lubricants and/or the industrial gear additive concentrates described above. Such methods include mixing the described components together. No particular order or means of addition is believed to significantly impact the results.

The invention also includes a method adding one of the industrial gear lubricants described herein to an industrial gearbox and then operating that industrial gearbox.

The industrial lubricant additive package may be present in the overall industrial lubricant from 1 to 5 percent by weight, or in other embodiments from 1, 1.5, or even 2 percent by weight up to 2, 3, 4, 5, 7 or even 10 percent by weight. Amounts of the industrial gear additive package that may be present in the industrial gear concentrate compositions of the invention are the corresponding amounts to the weight percent above, where the values are considered without the oil present (i.e., they may be treated as pbw values along with the actual amount of oil present).

In some embodiments, the lubricant composition may be an industrial gear lubricant. The industrial gear lubricant may comprise:

- 0.1 wt % to 0.5 wt % of the disclosed phosphonate ester,
- 0.0001 wt % to 0.15 wt % of a corrosion inhibitor chosen from 2,5-bis(tert-dodecyldithio)-1,3,4-thiadiazole, tolyltriazole, or mixtures thereof,
- an oil of lubricating viscosity,
- 0.02 wt % to 3 wt % of antioxidant chosen from aminic or phenolic antioxidants, or mixtures thereof,
- 0.005 wt % to 1.5 wt % of a borated succinimide or a non-borated succinimide,
- 0.001 wt % to 1.5 wt % of a neutral or slightly overbased calcium naphthalene sulphonate (typically a neutral or slightly overbased calcium dinonyl naphthalene sulphonate), and
- 0.001 wt % to 2 wt %, or 0.01 wt % to 1 wt % of an antiwear agent (other than the phosphonate ester of the present invention) chosen from zinc dialkyldithiophosphate, zinc dialkylphosphate, amine salt of a phosphorus acid or ester, or mixtures thereof.

The industrial gear lubricant may also comprise a formulation defined in the following table:

Industrial Gear Lubricant Compositions

| | Embodiments (wt %) | | |
|---|---|---|---|
| Additive | A | B | C |
| Phosphonate Ester | 0.02 to 0.5 | 0.02 to 0.4 | 0.02 to 0.3 |
| Sulfurized Olefin | 0 to 5.0 | 0.01 to 4.0 | 0.1 to 3 |
| Dispersant | 0 to 2.0 | 0.005 to 1.5 | 0.01 to 1.0 |
| Antifoam Agent | 0.001 to 0.02 | 0.001 to 0.01 | 0.001 to 0.003 |
| Demulsifier | 0.002 to 2 | 0.0025 to 0.5 | 0.005 to 0.04 |
| Metal Deactivator | 0.001 to 0.5 | 0.01 to 0.04 | 0.015 to 0.03 |
| Rust Inhibitor | 0.001 to 1.0 | 0.005 to 0.5 | 0.01 to 0.25 |
| Amine Phosphate | 0 to 3.0 | 0.005 to 2 | 0.01 to 1.0 |
| Oil of Lubricating Viscosity | Balance to 100% | Balance to 100% | Balance to 100% |

Specific examples of an Industrial Gear lubricant include those summarized in the following table:

Industrial Gear Lubricant Compositions

| | Embodiments (wt %) | | |
|---|---|---|---|
| Additive | A | B | C |
| Phosphonate Ester | 0.02 to 0.5 | 0.02 to 0.4 | 0.02 to 0.3 |
| Dispersant | 0.1 | 0.1 | 0.1 |
| Polyacrylate Antifoam Agent | 0.02 | 0.02 | 0.02 |
| Alkoxylated Demulsifier | 0.01 | 0.01 | 0.01 |
| Thiazole/Triazole Metal Deactivators | 0.035 | 0.035 | 0.035 |
| Fatty Amine Rust Inhibitor | 0.05 | 0.05 | 0.05 |
| Sulfurized Olefin | 1.0 | 1.0 | 1.0 |
| Oil of Lubricating Viscosity | Balance to 100% | Balance to 100% | Balance to 100% |

Driveline Applications

In some embodiments, the lubricant composition may be a manual transmission lubricant. The manual transmission may comprise (on an oil-free basis) the formulation in the table below:

| Component | Treat rate range |
|---|---|
| Corrosion inhibitor | 0.1 to 1 |
| Antioxidant | 0.2 to 0.5 |
| Detergent | 0.1 to 1.5 |
| Succinimide dispersant | 0.5 to 2 |
| Viscosity modifier | 0 to 10 |
| Phosphonate ester | Sufficient to deliver 350 to 1000 ppm phosphorous |
| Base Oil | Balance to 100 |

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain atoms other than carbon in a ring or chain otherwise composed of carbon atoms. Heteroatoms include sulfur, oxygen, nitrogen, and encompass substituents as pyridyl, furyl, thienyl and imidazolyl. In general, no more than two, or no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Products are prepared by reacting dimethylphosphite (DMPH) with 2-butyl-2-ethyl-1,3-propanediol (BEPD) or an alcohol mixture comprising 2-butyl-2-ethyl-1,3-propanediol (BEPD) and 1,6-hexanediol.

The following is an example of a specific synthesis without any 1,6-hexanediol: A 5 L flask was charged with 2-butyl-2-ethyl-1,3-propanediol (12.0 mol) and dimethyl phosphite (12.08 mol) and heated to 150° C. Methanol was removed by continuous distillation under a flow of nitrogen (1 cfh). After 4 h, collection of methanol had abated. The mixture was vacuum stripped to 3 torr/150° C. to remove any traces of methanol and unreacted DMPH. After 1 h, the product was jarred as a colorless liquid.

Another sample was prepared using an alcohol mixture comprising 99 mol % 2-butyl-2-ethyl-1,3-propanediol (BEPD) and 1 mol % 1,6-hexanediol, which the ordinarily skilled person will understand how the alcohol mixture may be varied to obtain the various embodiments disclosed and/or claimed herein: A 5 L flask was charged with 2-butyl-2-ethyl-1,3-propanediol (2.73 mol), 1,6-hexanediol (0.028 mol) and dimethyl phosphite (2.73 mol) and heated to 135° C. Methanol was removed by continuous distillation under a flow of nitrogen (1 cfh). After 5 h, collection of methanol had abated. The mixture was vacuum stripped to 50 torr/135° C. to remove any traces of methanol and unreacted DMPH. After 0.5 h, the product was jarred as a colorless liquid.

Additional samples were prepared in a similar fashion as described above, with a repeat of the 99:1 molar ratio as well as molar ratios of 98:2, 97:3, 96:4, and 95.5:4.5, 95:5 and 90:10.

The prepared phosphonate esters were added to a blend of Group I oils of lubricating viscosity to prepare an ISO 100 finished lubricant (viscosity at 40° C. is 100 cSt). The treat rate was 0.203 wt % phosphonate esters in the finished lubricant (250 ppm phosphorus). The samples were tested using ASTM D1401, D2782, D2783, and a storage stability test. The lubricants' properties were then tested and summarized in Table 1 below.

For ASTM D1401, 40 mL of the prepared samples and 40 mL of distilled water are stirred for about 5 minutes at about 54° C. in a graduated cylinder. The amount of separation is measured after every 5 minutes of the test until less than or equal to 3 mL of emulsion remains or the final time of 60 minutes if reached. The emulsion may be measured as follows: Oil mL/Water mL/Emulsion mL (time min). The first number is the amount of oil layer in mL, the second number is the amount of water layer in mL and the final number is the amount of emulsion in mL. The time is recorded in minutes. A result of 3 mL of emulsion or less at 30 minutes is often required. In typical industrial gear oil specifications, a requirement of 3 mL of emulsion or less is required in 30 minutes.

For ASTM D2782, fluid samples are preheated to 37.8±2.8° C. (100±5° F.) before starting the test. Two determinations are made: the minimum load (score value) that will rupture the lubricant film being tested between the rotating cup and the stationary block and cause scoring or seizure; and the maximum load (OK value) at which the rotating cup will not rupture the lubricant film and cause scoring or seizure between the rotting cup and the stationary block. In typical industrial gear oil specifications, a requirement of 60 lb OK load is required.

For ASTM D2783, the tester is operated with one steel ball under load rotating against three steel balls held stationary in the form of a cradle. The rotating speed is 1760±40 rpm. Lubricating fluids are brought to between 18 and 35° C. (65 to 95° F.) and then subjected to a series of tests of 10-seconds duration at increasing loads until welding occurs. In typical industrial gear oil specifications, a requirement of 45 kg or greater load wear index is required.

For the storage stability test, samples are stored for 4 weeks at −18, 0, room temperature (RT), and 65° C. Ratings are given to the samples each week for each temperature. Additionally, samples held at −18, 0, or 65° C. are rated when they have cooled or heated back to room temperature.

TABLE 1

| Example | Propanediol (BEPD) (ii), mole % | Alkylene diol (1,6-hexanediol) (iii), mole % | D1401 Oil-water emulse (mL and min) | D2782 (lb) | D2783 4-ball load wear index (kg) | Storage Stability (−18/0/RT/65) (° C.) |
|---|---|---|---|---|---|---|
| Control[A] | 0 | 0 | 41/35/04 (60) | 65 | 40.4 | Hazy, Sediment-All 4 temps. |
| 1 | 100 | 0 | 41/27/2 (20) | 75 | 55.7 | Clear All 4 temps. |
| 2 | 99 | 1 | 41/38/1 (20) | 60 | 46.1 | Clear All 4 temps. |
| 3[B] | 99 | 1 | 41/38/1 (25) | 60 | 46.4 | Clear All 4 temps. |
| 4 | 98 | 2 | 41/36/3 (15) | 60 | 46.8 | Clear All 4 temps. |
| 5 | 97 | 3 | 42/35/3 (20) | 70 | 47.3 | Clear All 4 temps. |
| 6 | 96 | 4 | 42/35/3 (15) | 60 | 56.5 | Clear All 4 temps. |
| 7 | 95.5 | 4.5 | 40/38/2 (25) | 45 | 46.6 | Clear All 4 temps. |
| 8 | 95 | 5 | 41/37/2 (60) | 45 | 35.8[C] | Clear All 4 temps. |
| 9 | 90 | 10 | 42/36/2 (60) | 40 | 32.5 | Clear All 4 temps. |

[A]The Control is treated with phosphonate ester that is primarily oligomeric at 0.168 wt % (250 ppm phosphorus), based on a total weight of the lubricant.
[B]3 is a repeat of example 2.
[C]200 kg weld point. All others have 250 kg weld point.

Examples 1 through 7 in particular show an improved performance in demulsibility compared to the control. In addition to demulsibility, Examples 1 through 6 show an improvement in the Timken and 4-ball wear tests as compared to the control.

The phosphonate esters described above may be formulated into a lubricant characteristic of a continuously variable transmission (CVT) fluid. The lubricant may contain the following components (weight percents): Dispersants (borated and/or treated with a dimercaptothiadiazole, 3.1%); Overbased calcium detergents (0.41%); Borate ester friction modifier (0.12%); Alkyl borate (0.35%); Ethoxylated amine friction modifier (0.03%); Friction stabilizer (0.08%); Alkyl acetamide (1%); Long chain hydroxyalkylamine (0.08%); Ester synthetic fluid (0.4%); Antioxidant (0.8%); Substituted triazole (0.02%); Substituted thiadiazole (0.1%); Seal swell agent (0.5%); Pour point depressant (0.1%); Viscosity index modifiers (7.92%); commercial antifoam agents (0.1%); Mineral base oil (balance to=100%). The phosphonate esters may be added at 0.26% by weight to the CVT formulation. For comparative purposes, a conventional phosphite, dibutylphosphite (dibutyl hydrogen phosphite, "DBP") may be used, also at 0.26% by weight.

The fully formulated lubricants may be tested using a 3-element variable speed friction tester (VSFT) test. In this test, three belt elements from a CVT belt are located against a metal surface, lubricated with the test fluid, to simulate the contact interface of an actual CVT belt and pulley. After a short break-in period, several cycles are run under a load of 306.5 kg with the speed varying between 300 rpm and 0 rpm, at a temperature of 100° C. The static coefficient of friction is the maximum value obtained during each cycle.

The phosphonate esters described above may be formulated into a lubricant characteristic of an automatic transmission fluid. The transmission fluid contains 3.37 percent by weight of borated succinimide dispersants, 1.42 percent by weight of friction modifiers, 0.22 percent by weight of metal-containing detergents, 0.08 percent by weight of anti-wear agent(s), 0.11 percent by weight of friction stabilizer, 1.68 percent by weight polymeric viscosity modifier(s), and 2.99 percent by weight of a combination of one or more seal swell agents, antioxidants, antifoam agents, pour point depressants, and corrosion inhibitor. The formulation may be prepared in mineral oil. The phosphonate esters may be added at 0.2 percent by weight. For comparative purposes, a conventional phosphonate ester, dibutylphosphite (dibutyl hydrogen phosphite, "DBP") may be used, also at 0.26% by weight. The fully formulated lubricants may be tested to the Mercon V Four-Ball test, according to ASTM D4172 and the Mercon Falex EP test according to ASTM D3233.

A lubricant formulation characteristic of a dual-clutch transmission fluid may be prepared for testing, including the following components: Nitrogen-containing dispersant(s) (3%), Corrosion inhibitor (0.5%); Overbased calcium sulfonate detergent (0.12%); Friction modifiers (0.49%); Friction stabilizer (0.1%); Antioxidant (0.6%); Seal swell agent (0.35%); Antifoam agent(s) (0.02%); Viscosity modifier (10.9%); Mineral base oil (balance to=100%). The phosphonate esters may be added at 0.26% by weight to the dual-clutch formulation. For comparative purposes, a conventional phosphite, dibutylphosphite (dibutyl hydrogen phosphite, "DBP") may be used, also at 0.26% by weight.

A lubricant formulation, characteristic of the core formulation of a manual transmission fluid, is prepared for testing, including the following components as in Table 2 below.

TABLE 2

| | Treat Rate (percentage) | | |
|---|---|---|---|
| Component | Fluid 1 | Fluid 2 | Fluid 3 |
| Thiadiazole type corrosion inhibitor | 0.1 | 0.1 | 0.1 |
| Aminic antioxidant | 0.3 | 0.3 | 0.3 |
| Calcium sulfonate detergent, 690 TBN | 0.58 | 0.58 | 0.58 |

TABLE 2-continued

| Component | Treat Rate (percentage) | | |
|---|---|---|---|
| | Fluid 1 | Fluid 2 | Fluid 3 |
| Succinimide dispersant, borated | 1.7 | 1.7 | 0.84 |
| Antifoam | 0.005 | 0.005 | 0.005 |
| Viscosity modifier | 3.0 | 3.0 | 3.0 |
| Disclosed phosphonate esters | 0.61 | 0.41 | 0.41 |
| Kinematic viscosity (ASTM D2177) | 5.9 cSt | 5.9 cSt | 5.3 cSt |
| Base Oil | Balance to 100 | | |

Fluid 1 Testing

4 Ball Wear Test (A Widely Used Industry Test)

Conditions: Falex balls, 60 mins, 1200 rpm, 40 Kg test duration 3600 seconds and at temperatures given below. The mean wear scar diameter is taken from three readings.

| Temp/C. | 40 | 55 | 75 | 110 | 135 |
|---|---|---|---|---|---|
| Mean Wear Scar Diameter/mm | 0.468 | 0.455 | 0.664 | 0.49 | 0.631 |

FE8 Roller Bearing Test

The FE8 wear test can be used to assess a lubricant's effect under service conditions on the frictional behavior and wear of a variety of bearings, including cylindrical roller thrust bearings. Two test cylindrical roller thrust bearings, 81212, are mounted in the FE8 test rig, subjected to an axial bearing load, operated at a particular speed and held at a test temperature. The full test details are given below. The rig and testing regime conform to DIN 51819 T1-T3. The test is conducted in duplicate to confirm the results.

Conditions

| Test parameters | |
|---|---|
| Axial load | 100 kN |
| Speed | 7.5 rpm |
| Fluid volume | 21 |
| Temperature | 80° C. (at the housing washers) |
| Cage material | polyamide |
| Oil flow rate | 0.1 l/min (each bearing) |
| Test duration | 80 h |
| Filter size | 10 μm |

In the wear test, the loss of weight of the bearing components reflects the ability of the lubricant to protect bearings. The formulation comprising Inventive Cyclic Phosphonate Ester (Fluid 1) reached 80 hours without interruption with the following washer, cage and roller weight losses (mg).

| Fluid 1 | | |
|---|---|---|
| Housing Washer | 8 | 6 |
| Shaft Washer | 6 | 4 |
| Cage | 50 | 3 |
| Rollers | 5 | <2 |

| Fluid 3 | | |
|---|---|---|
| Housing Washer | 2 | 2 |
| Shaft Washer | <2 | 2 |

-continued

| Fluid 3 | | |
|---|---|---|
| Cage | 58 | 41 |
| Rollers | <2 | <2 |

The wear characteristics of a manual transmission fluid comprising the component were assessed at two different temperatures under mixed and boundary lubrication conditions following the DGMK 377-01 procedure (DGMK 377-01: Method to assess the wear characteristics of lubricants). The DGMK test is a five stage test, four stages of 24 hours duration and the final stage being 48 hours. C-PT type test gears are run in an FZG test rig under the conditions shown in the table below. The pinion and wheel gears are weighed at the start of the test. At the end of each stage the gears are inspected for damage (for scratching, scoring polishing and scuffing) and the cumulative weight loss (of both wheel and pinion) is reported for Fluid 1 in Table 3 below.

TABLE 3

| Test Conditions | Load Stage 12 (378.2 Nm on Pinion) | | | | |
|---|---|---|---|---|---|
| | C/0.05/90/12 | | C/0.05/120/12 | | C/0.57/90/12 |
| Wheel Speed (RPM) | 9 | 9 | 9 | 9 | 100 |
| Temperature (° C.) | 90 | 90 | 120 | 120 | 120 |
| Wheel Revolutions | 12,500 | 12,500 | 12,500 | 12,500 | 288,000 |
| Approximate Run Time (hr) | 24 | 24 | 24 | 24 | 24 |
| Cumulative Run Time (hr) | 24 | 48 | 72 | 96 | 144 |
| Weight Loss (Cumulative) | | | | | |
| Pinion Gear (mg) | 2 | 2 | 2 | 10 | 42 |
| Wheel Gear (mg) | 5 | 4 | 3 | 15 | 45 |
| Total Weight Loss (mg) | 7 | 6 | 5 | 26 | 86 |
| Gear Teeth Condition | | | | | |
| Scratching Score | 6 | 6 | 24 | 24 | 24 |
| Polishing | 8 | 15 | 17 | 35 | 35 |
| Scuffing | | | | | |

Note:

Values for gear teeth condition are number of pinion + wheel teeth affected.

Weight loss values are corrected measurements using a reference set of gears. Each individual measurement of pinion or wheel mass is subject to an uncertainty of weighing of ±5 mg.

Fluid 2 Testing

Similarly, the antiwear performance of Fluid 2 was assessed using a different test C/0.05/90:120/12, again in the FZG rig using C-PT type gears under the conditions shown in Table 2. This is a three stage test, each stage being 20 hours duration. The pinion and wheel gears are weighed at the start of the test. At the end of each 20 hour stage the gears are inspected for damage (for scratching, scoring polishing and scuffing) and the cumulative weight loss is reported. Small oil aliquots are taken every 4 hours and the iron content determined using ICP (by ASTM D5185). The test results for Fluid 2 are shown in Table 4 below.

TABLE 4

| | SOT | Part 1 | Part 2 | Part 3 |
|---|---|---|---|---|
| | Load Stage 12 (378.2 Nm on Pinion) | | | |
| Test Conditions | | C/0.05/90/12 | C/0.05/120/12 | C/0.57/90/12 |
| Wheel Speed (RPM) | | 9 | 9 | 100 |
| Temperature (° C.) | | 90 | 120 | 90 |
| Wheel Revolutions | | 10,800 | 10,800 | 120,000 |
| Approximate Run Time (hr) | | 20 | 20 | 20 |
| Cumulative Run Time (hr) | | 20 | 40 | 60 |
| Weight Loss (Cumulative) | | | | |
| Pinion Gear (mg) | 0 | 0 | 1 | 3 |
| Wheel Gear (mg) | 0 | 0 | 4 | 6 |
| Total Weight Loss (mg) | 0 | 0 | 5 | 9 |
| Iron Concentration (ppm) | 1 | 3 | 3 | 6 |
| Gear Teeth Condition | | | | |
| Scratching Score | | 16 | 18 | 18 |
| Polishing | | | | |
| Scuffing | | | | |

Note:

Values for gear teeth condition are number of pinion + wheel teeth affected.

Weight loss values are corrected measurements using a reference set of gears. Iron concentration is determined from ASTM D5185 analysis of samples taken while test rig is running.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising:

(a) an oil of lubricating viscosity and (b) a phosphonate ester other than a zinc salt, comprising the reaction product of (i) phosphonic acid and (ii) an alcohol mixture comprising a propanediol having hydroxy groups in the 1 and 3 positions and wherein one or more of the carbon atoms of the propyl units are substituted such that the total number of carbon atoms in the propanediol ranges from 4 to 12 and an alkane diol having two hydroxy groups in a 1, 4 or 1, 5 or 1, 6 relationship; and wherein the relative molar amounts of the propanediol and the alkane diol in the alcohol mixture are in a ratio greater than 95:5; and wherein the molar ratio of (i) to (ii) is 0.9:1.1 to 1.1:0.9.

2. The lubricant composition of claim 1, wherein the propanediol comprises an alkyl-substituted 1,3-propane diol with one or more of the alkyl substituents thereof being on one or more of the carbon atoms of the propyl unit such that the total number of carbon atoms in the alkyl-substituted 1,3-propane diol ranges from 5 to 12.

3. The lubricant composition of claim 1, wherein the relative molar amounts of the propanediol and the alkane diol in the alcohol mixture are in a ratio of 96:4 to 99:1.

4. The lubricant composition of claim 1, wherein the alcohol mixture further comprises a mono alcohol having 2 to 20 carbon atoms, and wherein the mono alcohol is present at 0.1 to 1 wt %, based on a total weight of the total alcohol mixture.

5. The lubricant composition of claim 1, wherein the amount of the phosphonate ester ranges from 0.05 to 0.5 wt %, based on a total weight of the lubricant composition.

6. The lubricant composition of claim 1, wherein the monomeric phosphonate ester comprises dimethyl phosphite.

7. The lubricant composition of claim 1, wherein the propanediol comprises 2-ethyl-2-butyl-1,3-propanediol, 2-ethylhexane-1,3-diol, 2,2-dibutyl-1,3-propanediol, 2-methyl-2-propyl-1,3-propanediol, or combinations thereof.

8. The lubricant composition of claim 1, wherein the alkane diol comprises 1,4-butanediol, 1,5-pentanediol, 1,6-hexanediol, or mixtures thereof.

9. The lubricant composition of claim 1, wherein the phosphonate ester comprises at least one oligomeric species comprising 2 to 20 phosphorus atoms and at least one cyclic monomeric species comprising a single phosphorus atom.

10. The lubricant composition of claim 1, comprising a cyclic monomeric species comprising a single phosphorus atom and a chain of 3 carbon atoms derived from the propanediol.

11. The lubricant composition of claim 9, wherein the weight ratio of the cyclic monomeric species to the amount of the oligomeric species is 8:1 to 3:1.

12. The lubricant composition of claim 1, wherein the oil of lubricating viscosity is a Group I base oil.

13. The lubricant composition of claim 12, wherein the Group I base oil has a kinematic viscosity at 40° C. of 18 to 115 cSt.

14. The lubricant composition of claim 1, further comprising at least one dispersant, viscosity modifier, antioxidant, or corrosion inhibitor.

15. The lubricant composition of claim 14 comprising a substituted thiadiazole corrosion inhibitor.

16. The lubricant composition of claim 1, wherein the lubricant composition has a Timken rating as measured using D2782 of greater than 45 pounds.

17. The lubricant composition of claim 1, wherein the lubricant composition has a 4-ball weld point of at least 200 kilograms-force and a load wear index of at least 45 kilograms-force as measured using D2783.

18. A method for lubricating a mechanical device, comprising supplying thereto the lubricant composition of claim 1.

19. The method of claim 18 wherein said mechanical device is a drivetrain component.

20. The method of claim 19 wherein said drivetrain component is an automatic transmission, a manual transmission, a dual clutch transmission, or a continuously variable transmission.

21. The method of claim 19 wherein said mechanical device comprises a gear.

* * * * *